US005555926A

United States Patent [19]

Uchimura et al.

[11] Patent Number: 5,555,926

[45] Date of Patent: Sep. 17, 1996

[54] PROCESS FOR THE PRODUCTION OF SEMI-SOLIDIFIED METAL COMPOSITION

[75] Inventors: Mitsuo Uchimura; Tsukasa Shinde; Kazutoshi Hironaka; Hiroyshi Takahashi; Akihiko Nanba, all of Chiba, Japan

[73] Assignee: Rheo-Technology, Ltd., Japan

[21] Appl. No.: 296,746

[22] Filed: Aug. 26, 1994

[30] Foreign Application Priority Data

| | | | |
|---|---|---|---|
| Dec. 8, 1993 | [JP] | Japan | 5-340248 |
| Dec. 8, 1993 | [JP] | Japan | 5-340249 |
| Dec. 8, 1993 | [JP] | Japan | 5-340250 |
| Jul. 19, 1994 | [JP] | Japan | 6-187855 |

[51] Int. Cl.[6] ..... B22D 27/02; B22D 27/08

[52] U.S. Cl. ..... 164/468; 164/71.1; 164/478; 164/479; 164/499; 164/900

[58] Field of Search ..... 164/900, 71.1, 164/499, 468, 479, 478

[56] References Cited

U.S. PATENT DOCUMENTS 4,434,837 3/1984 Winter et al. .

FOREIGN PATENT DOCUMENTS

| | | |
|---|---|---|
| 0069270A1 | 1/1983 | European Pat. Off. . |
| 0095597A2 | 12/1983 | European Pat. Off. . |
| 0269180B1 | 6/1988 | European Pat. Off. . |
| 0483943A2 | 5/1992 | European Pat. Off. . |
| 0492761A1 | 7/1992 | European Pat. Off. . |

*Primary Examiner*—Kuang Y. Lin
*Attorney, Agent, or Firm*—Austin R. Miller

[57] ABSTRACT

A semi-solidified metal composition having an excellent workability is continuously produced by pouring molten metal into an upper part of a cooling agitation mold, agitating it while cooling to produce a slurry of solid-liquid mixed phase containing non-dendritic primary solid particles dispersed therein and discharging out the slurry from a lower part of the cooling agitation mold. In this case, a ratio of shear strain rate at a solid-liquid interface to solidification rate of molten metal is adjusted to a value exceeding 8000 in the cooling agitation mold.

6 Claims, 13 Drawing Sheets

100 μm

100 μm

100μm

100μm

200 μm

PROCESS FOR THE PRODUCTION OF SEMI-SOLIDIFIED METAL COMPOSITION

BACKGROUND OF THE INVENTION

1. Field of the Invention

This invention relates to a process for stably and continuously producing a solid-liquid metal mixture (hereinafter referred to as a semi-solidified metal composition) having an excellent workability.

2. Description of the Related Art

As a means for continuously producing the semi-solidified metal composition, there is a well-known mechanical agitating process wherein molten metal is charged at a certain temperature into a space between inner surface of a cylindrical cooling agitation vessel and an agitator rotating at a high speed and vigorously agitated while cooling and then the resulting semi-solidified metal composition is continuously discharged from the bottom of the vessel (hereinafter referred to as an agitator rotating process) as disclosed, for example, in JP-B-56-20944 (relating to an apparatus for continuously forming alloys inclusive of non-dendritic primary solid particles). Furthermore, there is also a well-known process of using an electromagnetic force for the agitation of molten metal (hereinafter referred to as an electrormagnetic agitating process).

As disclosed in JP-A-4-238645 (relating to a process and apparatus for producing a semi-solidified metal composition, there is another process wherein molten metal is charged into a space between a rotating agitator composed of a cylindrical drum having a horizontally rotating axis and a cooling ability and a fixed wall member having a concave face along the outer periphery of the agitator and a discharging force is generated by shear strain at a solid-liquid interface produced through the rotation of the rotating agitator while cooling to continuously discharge the semi-solidified metal composition from a clearance at the bottom (hereinafter referred to as a single roll process).

In all of the above processes, the solid phase in the semi-solidified metal composition is formed by vigorously agitating molten metal (generally molten alloy) while cooling to convert dendrites produced in the remaining liquid matrix into a spheroidal shape such that dendritic branches are substantially eliminated or reduced.

As a working process for the thus obtained semi-solidified metal composition, there are known a thixocasting process wherein the semi-solidified metal composition is cooled and solidified and then reheated to a semi-molten state, a rheocasting process wherein the semi-solidified metal composition is supplied to a casting machine as it is, and so on.

If it is intended to work the semi-solidified metal composition by the thixo or rheo process, the castability is dependent upon the fraction solid during casting, size, shape and uniformity of primary crystal grains in the semi-solidified metal composition and the like. When the fraction solid during casting is too low (heat content is large), the mitigation of heat load as a great merit in the working of the semi-solidified metal composition is damaged, while when the fraction solid is too high, there are caused some problems such as an increase of working pressure required during casting, deterioration of filling property and the like. On the other hand, the castability is improved as the primary solid particles have a smaller particle size and a spheroidal shape and the dispersion of the primary solid particles becomes more uniform. Therefore, in order to manufacture sound worked products by improving the castability of the semi-solidified metal composition, it becomes important to control not only the fraction solid in the castability but also the particle size, shape and uniformity of the primary solid particles.

When the cooling rate is made higher to make the particle size of the primary solid particles fine in all of the above processes, the growth of a solidification shell becomes large and hence it is apt to cause problems such as a decrease of the cooling rate, coarsening of primary solid particles, deterioration of quality, stop of operation and the like.

In order to realize the production of the semi-solidified metal composition as an industrial process, it is important to stabilize the operation and to provide a good quality.

As a countermeasure for solving the above problems, JP-B-3-66958 (relating to a process for producing metal composition of slurry structure) proposes an agitator rotating process wherein a ratio of shear strain rate to solidification rate is held within a range of $2\times10^3$–$8\times10^3$. In this process, however, it is difficult to conduct continuous operations because the torque of the agitator is raised by contacting the solidification shell growing on the cooling wall surface of the agitation cooling vessel with the agitator, and also the semi-solidified metal composition having a given quality can not be obtained due to the change of the cooling rate accompanied with the growth of the solidification shell.

In the above single roll process described in JP-A-4-238645, sufficient cooling and shear strain effect can be provided by properly selecting the diameter and revolution number of the rotating agitator, and also the continuous discharge of the semi-solidified metal composition having a high viscosity and fraction solid can be facilitated. However, when using the rotating agitator having a large cooling rate, the solidification shell growing on the outer peripheral surface of the agitator becomes thicker and is scraped off by a scraping member in the form of a flake. Furthermore, the amount of the solidification shell scraped increases and is included into the semi-solidified metal composition, so that the quality and castability of the semi-solidified metal composition are considerably degraded.

SUMMARY OF THE INVENTION

It is, therefore, an object of the invention to advantageously solve the aforementioned problems of the conventional techniques and to provide a process for stably and continuously producing semi-solidified metal compositions having an excellent castability and containing fine non-dendritic primary solid particles uniformly dispersed therein irrespective of the kind of agitating means.

According to the invention, there is the provision of a process for continuously producing semi-solidified metal compositions having an excellent castability by pouring molten metal into an upper part of a cooling agitation mold, agitating it while cooling to produce a slurry of solid-liquid mixed phase containing non-dendritic primary solid particles dispersed therein and discharging the slurry from a lower part of the cooling agitation mold, characterized in that a ratio of shear strain rate at a solid-liquid interface to solidification rate of molten metal is adjusted to a value exceeding 8000 in the cooling agitation mold.

In a preferred embodiment of the invention, the cooling agitation mold is an agitator rotating apparatus comprising a cooling vessel, an agitator arranged in the vessel apart from an inner cooling face thereof, a motor for driving the agitator, and a sliding nozzle for controlling an amount of the slurry discharged. In another preferred embodiment of the invention, the cooling agitation mold is a single roll agitating apparatus comprising a rotating agitator composed of a cylindrical drum and having a horizontally rotational axis, and a cooling wall member having a concave face along an outer periphery of the drum, a scraping member for scraping a solidification shell adhered to the outer periphery of the drum, and a sliding nozzle for controlling the amount of the slurry discharged. In the other preferred embodiment of the invention, the cooling agitation mold is an electromagnetic agitating apparatus comprising a vertical cooling vessel provided with a water-cooled jacket and an electromagnetic induction coil arranged around an outer periphery of the vessel.

BRIEF DESCRIPTION OF THE DRAWINGS

The invention will be described with reference to the accompanying drawings, wherein.

DESCRIPTION OF THE PREFERRED EMBODIMENTS

The invention will be described with respect to the following experiment using each agitating process.

Figure 1:
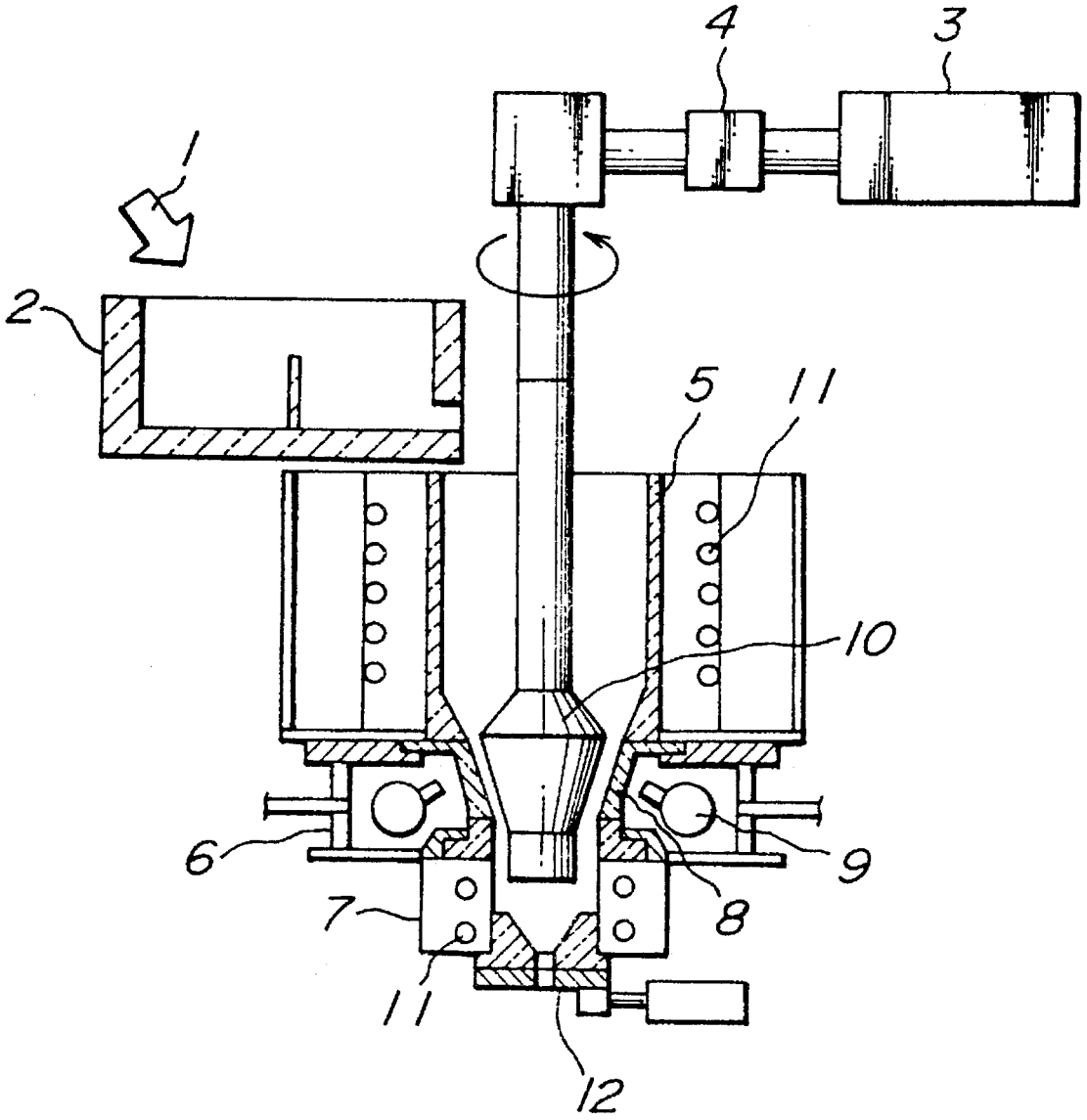
FIG. 1 is a diagrammatic view illustrating an apparatus for the production of semi-solidified metal composition through an agitator rotating process.

In FIG. 1 is diagrammatically shown an embodiment of the apparatus for the production of semi-solidified metal compositions through an agitator rotating process from molten metal 1 supplied to a tundish 2. This apparatus comprises a motor 3 for an agitator, a torque meter 4, a temperature controlled vessel 5, a cooling vessel 6, a temperature holding vessel 7, a cooling wall face 8 of the cooling vessel 6, a water spraying member 9, an agitator 10 provided at its outer surface with screw threads (not shown), a heater 11 and a sliding nozzle 12 for controlling a discharge amount of the resulting semi-solidified metal composition.

Various semi-solidified metal compositions of Al alloy are produced by variously varying conditions through the apparatus of FIG. 1, which are discharged from the apparatus and rapidly solidified to fix metal structures. Then, these metal structures are observed by means of a microscope to investigate particle size, shape and dispersion state of non-dendritic primary solid particles.

On the other hand, influences of particle size, shape and dispersion uniformity of the primary solid particles upon the castability of the semi-solidified metal composition are investigated by pouring a part of the semi-solidified metal composition into an adiabatic vessel having a very small thermal conductivity and subjecting to a rheocasting in a die casting machine, or by pouring a part of the semi-solidified metal composition into a mold to conduct solidification under cooling, reheating it to a semi-molten state and then subjecting to a thixocasting in a die casting machine.

In this experiment, the particle size, shape and dispersion uniformity of the primary solid particles in the semi-solidified metal composition discharged are controlled by the solidification rate of molten metal and the shear strain rate at the solid-liquid interface.

The solidification rate is a rate of increasing fraction solid in the cooling vessel 6 and is dependent upon the unit amount of molten metal and cooling amount per unit time. Therefore, the solidification rate is adjusted by a cooling rate ($Kcal/m^2 \cdot s$) and a cooling area ($m^2$) of the cooling vessel 6 and a space volume ($m^3$) between the cooling vessel 6 and the agitator 10, while the fraction solid of the semi-solidified metal composition discharged is controlled by a discharge rate.

The thus adjusted solidification rate is calculated according to the following equation (1) from a fraction solid based on results measured by a thermocouple arranged at the lower end of the temperature holding vessel and a residence time in the cooling vessel:

$$\text{Solidification rate } (s^{-1}) = dfs/dt \quad (1)$$

wherein dfs: fraction solid of semi-solidified metal composition discharged dt: space volume of cooling vessel ($m^3$)/discharge rate ($m^3/s$)

On the other hand, the shear strain rate at the solid-liquid interface is controlled by the revolution number of the agitator 10 and calculated according to the following equation (2). The value of $r_3$ used in this calculation is calculated according to the following equation (3) from a relation of a clearance S between the solidification shell produced on the cooling wall face 8 of the cooling vessel 6 and the agitator 10 (hereinafter referred to as clearance S simply) to a torque increase behavior of the agitator 10 provided that the clearance S starting the torque increase is 0.8 mm.

$$\gamma=2\cdot r_1\cdot r_3\cdot\Omega/(r_3^2-r_1^2) \quad (2)$$

$$r_3=r_2-D=S+r_1 \quad (3)$$

wherein $\gamma$: shear strain rate at solid-liquid interface ($s^{-1}$)

$r_1$: radius of agitator (m)

$r_2$: inner radius of cooling vessel (m)

$\Omega$: angular velocity of agitator (rad/s)

S: clearance (m)

$r_3$: radius of molten metal in cooling vessel (m)

D: thickness of solidification shell (m)

The experimental results are mentioned below.

Figure 2:
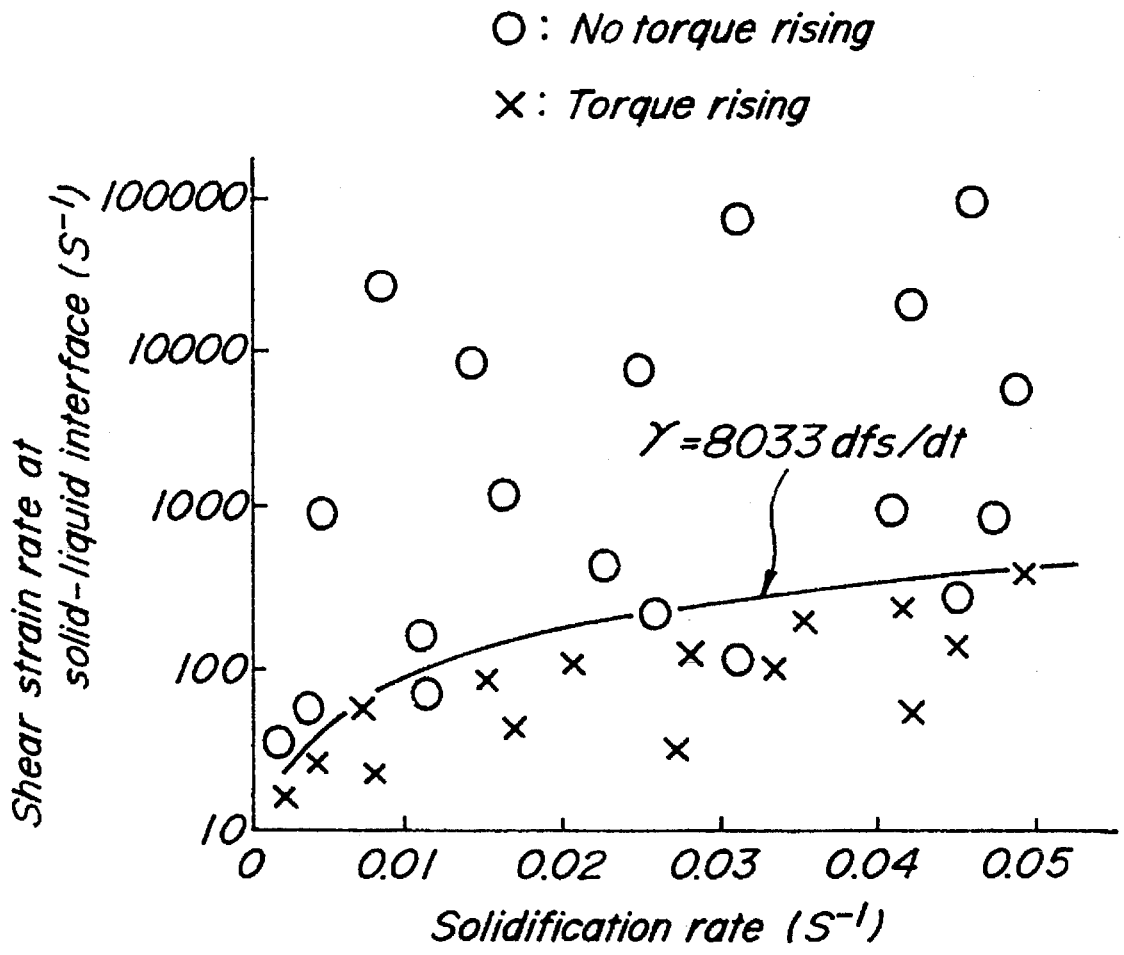
FIG. 2 is a graph showing a relation between solidification rate and shear strain rate to the absence or presence of an increase in agitator torque.

In FIG. 2 is shown a relation between the solidification rate and the shear strain rate to the presence or absence of increasing torque of the agitator 10.

The border line of increasing the torque of the agitator 10 based on the results of FIG. 2 is expressed by the following equation (4), while the condition showing no torque increase of the agitator 10 is expressed by the following equation (5). When the shear strain rate at the solid-liquid interface is larger than the value of the equation (4), the growth of the solidification shell is prevented at such a position that the clearance S is larger than 0.8 mm.

$$\gamma=8033\cdot(dfs/dt) \quad (4)$$

$$\gamma\geqq 8033\cdot(dfs/dt) \quad (5)$$

wherein $\gamma$: shear strain rate at solid-liquid interface ($s^{-1}$)

dfs/dt: solidification rate ($s^{-1}$)

Thus, when the clearance S is larger than 0.8 mm, even if troubles in operation such as displacement of the agitator 10 and the like occur, there is no torque increase and the stable operation is possible. Therefore, it is preferable that the shear strain rate calculated by the equations (2) and (3) using the clearance S=0.8 mm is made larger than the value calculated by the equation (4) as far as possible.

Figure 3:
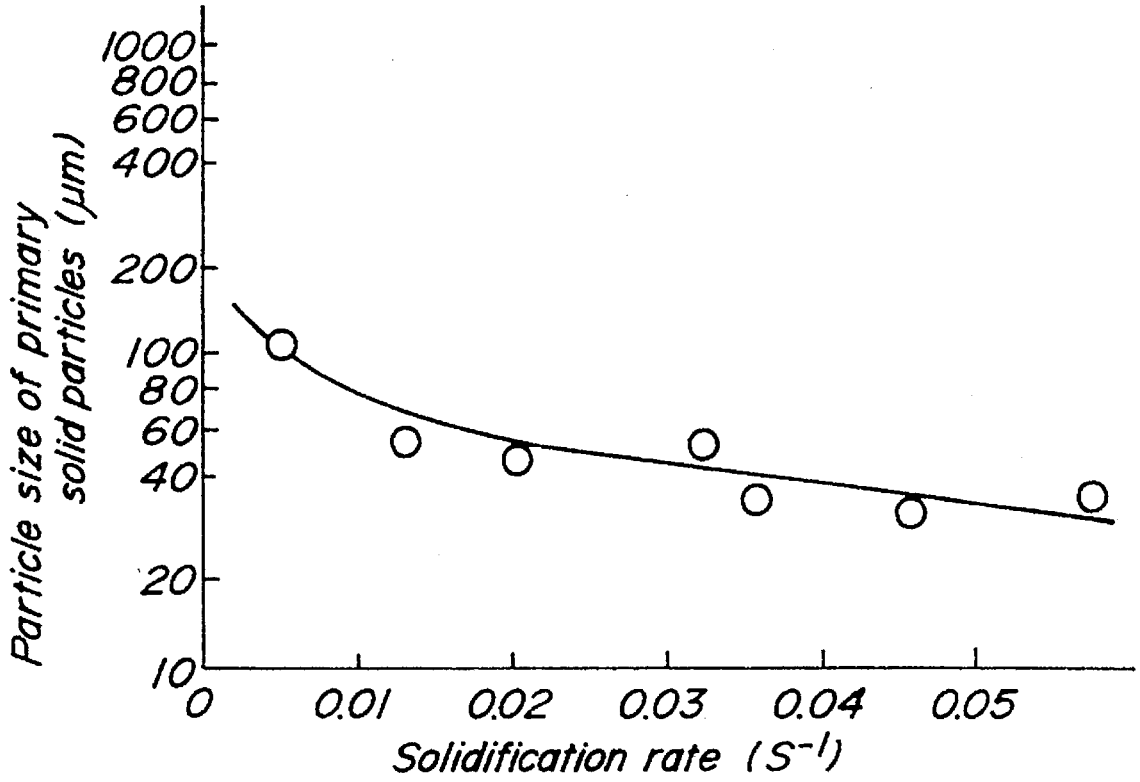
FIG. 3 is a graph showing a relation between particle size of non-dendritic primary solid particles in semi-solidified metal composition and solidification rate when the semi-solidified metal composition is discharged at a fraction solid of 0.3.
Figure 4A:
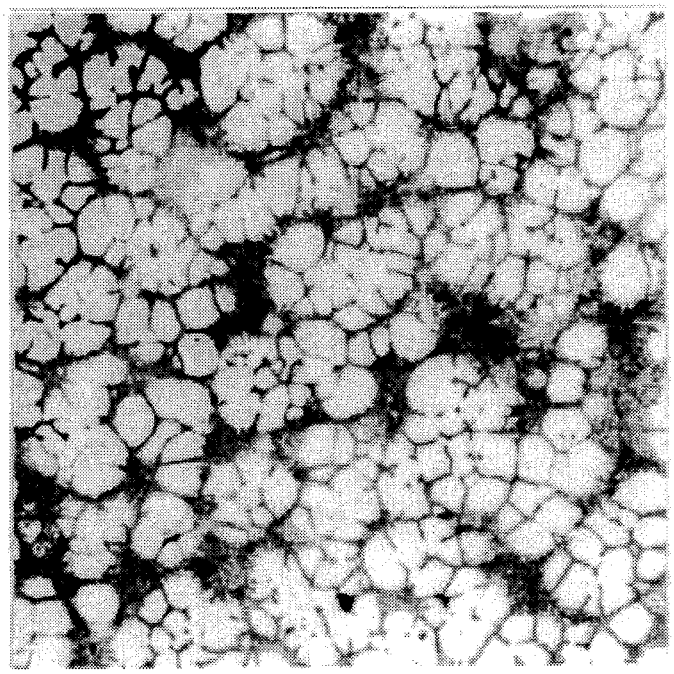
FIG. 4*a* is a microphotograph of a metal structure in a sample obtained by rapidly solidifying semi-solidified metal composition discharged under a condition that shear strain rate at solid-liquid interface is 500 $s^{-1}$.
Figure 4B:
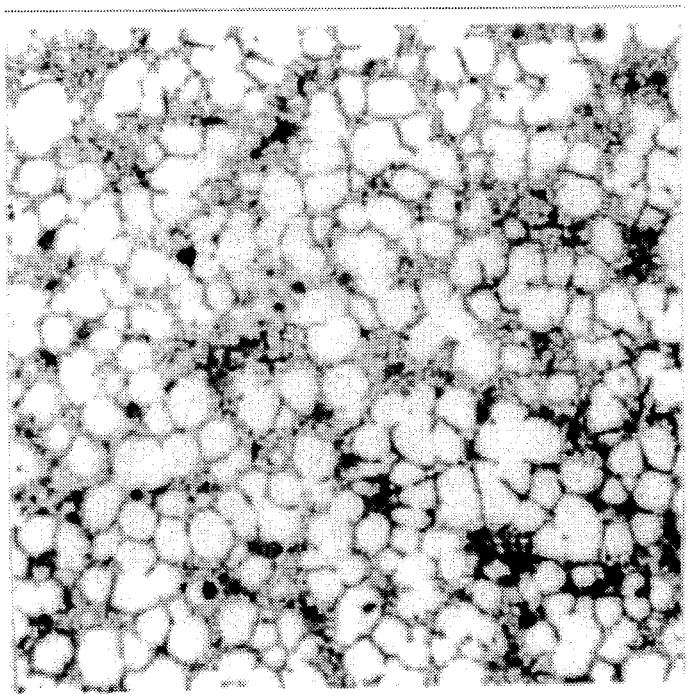
FIG. 4*b* is a microphotograph of a metal structure in a sample obtained by rapidly solidifying semi-solidified metal composition discharged under a condition that shear strain rate at solid-liquid interface is 15000 $s^{-1}$.

In FIG. 3 is shown a relation between the solidification rate and the particle size of non-dendritic primary solid particles in the semi-solidified metal composition discharged at a fraction solid of 0.3. As seen from FIG. 3, the particle size of the primary solid particles is made small as the solidification rate becomes large. In order to obtain finer primary solid particles, it is favorable that the solidification rate is not less than 0.02 $s^{-1}$. Moreover, FIGS. 4*a* and 4*b* show microphotographs of metal structures in samples obtained by rapidly solidifying semi-solidified metal compositions discharged under conditions that the shear strain rate at the solid-liquid interface is 500 $s^{-1}$ and 15000 $s^{-1}$, respectively. When the shear strain rate at the solid-liquid interface is small as shown in FIG. 4*a*, the primary solid particles form an aggregate, while when the shear strain rate at solid-liquid interface is large as shown in FIG. 4*b*, the primary solid particles are uniformly dispersed in the semi-solidified metal composition. In the latter case, it is considered that the primary solid particles hardly form the aggregate owing to the shear force or they are dispersed separately.

Table 1 shows particle sizes of primary solid particles, solidification rate, shear strain rate at the solid-liquid interface, ratio of shear strain rate to solidification rate, continuous discharge in semi-solidified metal composition of AC4C (Al alloy) having a fraction solid of 0.3 and a filling rejection rate in a mold cavity when the semi-solidified metal composition is subjected to rheocasting in a die casting machine, while Table 2 shows a filling rejection rate when the above semi-solidified metal composition is cooled and solidified and reheated to a semi-molten state having a fraction solid of 0.3–0.35 and then subjected to a thixocasting in a die casting machine.

TABLE 1

| Particle size of primary solid particles (μm) | Solidification rate (A) ($S^{-1}$) | Shear strain rate at solid-liquid interface (B) ($S^{-1}$) | (B)/(A) | Filling rejection ratio (%) | Continuous discharge |
|---|---|---|---|---|---|
| 40 | 0.03 | 200 | 6700 | — | un-acceptable due to torque rising |
| 100 | 0.005 | 500 | 100000 | 10 | acceptable |
| 40 | 0.03 | 500 | 16700 | 4 | acceptable |
| 40 | 0.03 | 15000 | 500000 | 0 | acceptable |

TABLE 2

| Particle size of primary solid particles (μm) | Solidification rate (A) ($S^{-1}$) | Shear strain rate at solid-liquid interface (B) ($S^{-1}$) | (B)/(A) | Filling rejection ratio (%) |
|---|---|---|---|---|
| 100 | 0.005 | 500 | 100000 | 12 |
| 40 | 0.03 | 500 | 16700 | 6 |
| 40 | 0.03 | 15000 | 500000 | 0 |

As seen from Tables 1 and 2, when the ratio of shear strain rate at the solid-liquid interface to the solidification rate is not more than 8000, the continuous discharge can not be conducted because the torque of the agitator rises. Even in both of rheocasting and thixocasting, it is understood that when the particle size of the primary solid particles dependent upon the solidification rate is small and the shear strain rate is large (the primary solid particles are uniformly dispersed), the filling rejection rate is low and the workability is good.

As mentioned above, in order to continuously produce the semi-solidified metal composition having an excellent castability without increasing the torque of the agitator through the agitator rotating process, it is important that the operation is conducted by increasing the solidification rate as far as possible and making the shear strain rate at the solid-liquid interface as large as possible and satisfying the relation of the equation (5).

Figure 5:
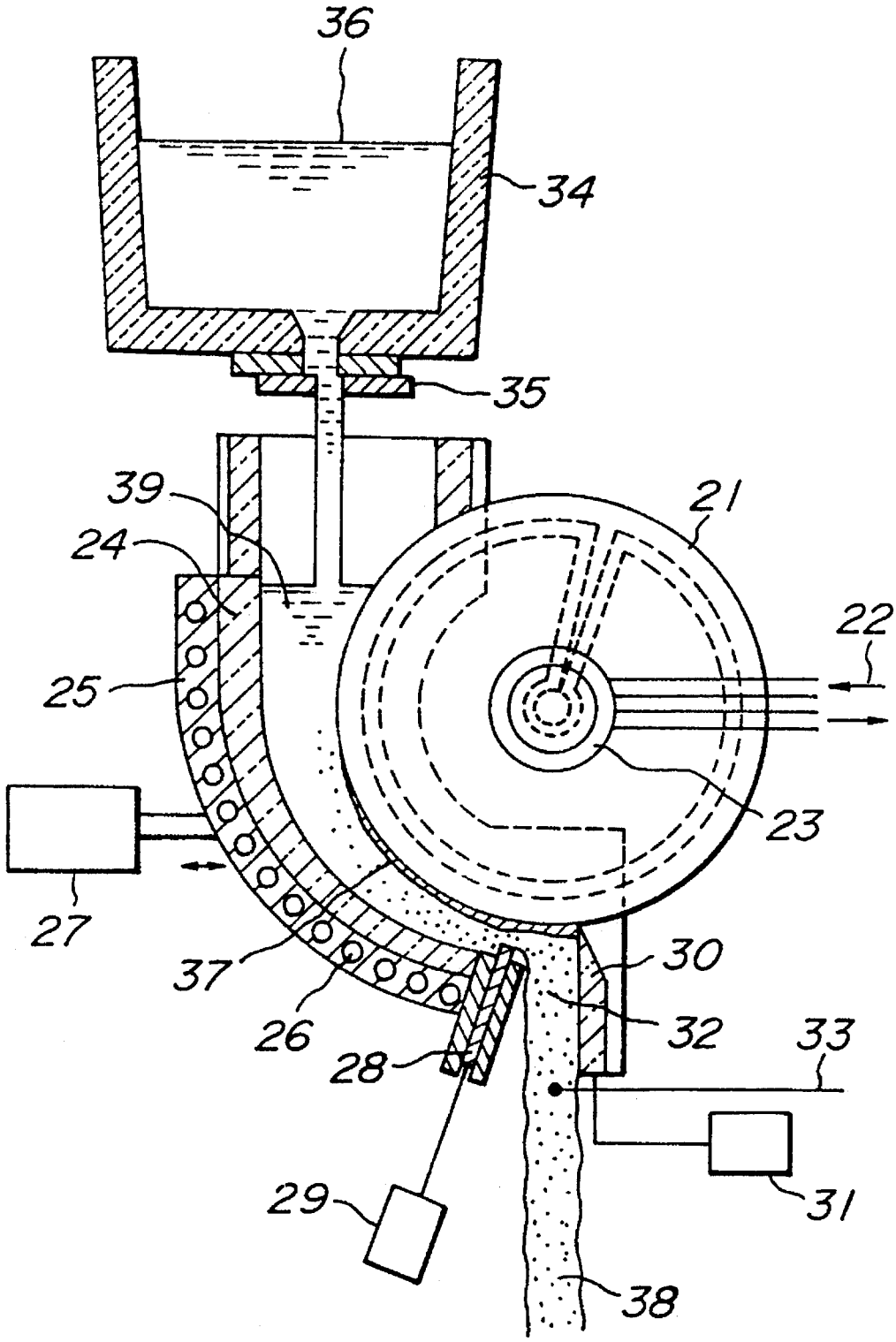
FIG. 5 is a diagrammatic view illustrating an apparatus for the continuous production of semi-solidified metal composition through a single roll agitating process.

In FIG. 5 is diagrammatically shown an apparatus for the continuous production of semi-solidified metal composition through a single roll agitating process. This apparatus comprises a rotating agitator 21 composed of a cylindrical drum and having a given cooling ability, a cooling water system 22, a driving system 23 for the rotating agitator 21, a refractory plate 24 constituting a molten metal reservoir, a movable wall member 25 made from a refractory material, a heater 26 for heating the wall member 25, a driving mechanism 27 for adjusting the position of the wall member 25, a dam plate 28 disposed at a lower end of the wall member 25, a mechanism 29 for slidably driving the dam plate 28, a scraping member 30 for scraping off solidification shell 37 adhered and grown onto a peripheral surface of the cylindrical drum as the rotating agitator 21, a driving mechanism 31 for adjusting a distance to the rotating agitator 21, a discharge port 32 and a sensor 33 for detecting the fraction solid of semi-solidified metal composition 38 discharged, in which a cooling agitation mold 39 is defined by the rotating agitator 21, the refractory plate 24 and the movable wall member 25.

Various semi-solidified metal compositions of Cu alloy are produced by variously varying conditions through the apparatus of FIG. 5, which are discharged from the apparatus and rapidly solidified between two copper plates to fix metal structures. Then, these metal structures are observed by means of a microscope to investigate the shape of fluids of the liquid phase or flakes of the solid phase as a quality of the semi-solidified metal composition.

Furthermore, the semi-solidified metal composition discharged is poured into an adiabatic vessel having a very small thermal conductivity and subjected to a rheocasting in a die casting machine, or cooled and solidified in a mold and reheated to a semi-molten state and then subjected to a thixocasting in a die casting machine. Next, an occurring ratio of defects in the cast product is measured to examine a reaction to the above investigated shape of the semi-solidified metal composition.

In this experiment, the quality of the semi-solidified metal composition discharged is changed by the solidification rate of molten metal and the shear strain rate at the solid-liquid interface. The solidification rate is a velocity of increasing the fraction solid in the cooling agitation mold 39 and is dependent upon a unit amount of molten metal and a cooling amount per unit time, so that it is adjusted by changing the thickness of the cylindrical drum as the rotating agitator 21 to control the cooling rate (kcal/m$^2$·s). On the other hand, the fraction solid of the semi-solidified metal composition discharged is controlled by the discharge rate.

The thus adjusted solidification rate is calculated according to the following equation (6) from fraction solid measured by the sensor 33 and residence time in the cooling agitation vessel 39:

$$\text{Solidification rate } (s^{-1}) = dfs/dt \quad (6)$$

wherein dfs: fraction solid of semi-solidified metal composition discharged dt: space volume of cooling agitation vessel (m$^3$)/discharge rate (m$^3$/s)

On the other hand, the shear strain rate at the solid-liquid interface is adjusted by the revolution number of the rotating agitator 21, clearance between the dam plate 28 and solidification shell produced on the outer peripheral surface of the rotating agitator 21 and calculated according to the following equations (7) and (8):

$$\gamma = 2\times(2\cdot\pi\cdot n)\times\{r_2\times(r_2+h)\}/(h^2+2\cdot r_2\cdot h) \quad (7)$$

$$r_2 = r_1 + t \quad (8)$$

wherein $\gamma$: shear strain rate at solid-liquid interface (s$^{-1}$)

n: revolution number of agitator (s$^{-1}$)

$r_1$: radius of agitator (m)

t: thickness of solidification shell (m)

h: clearance between solidification shell and dam plate (m)

Figure 6:
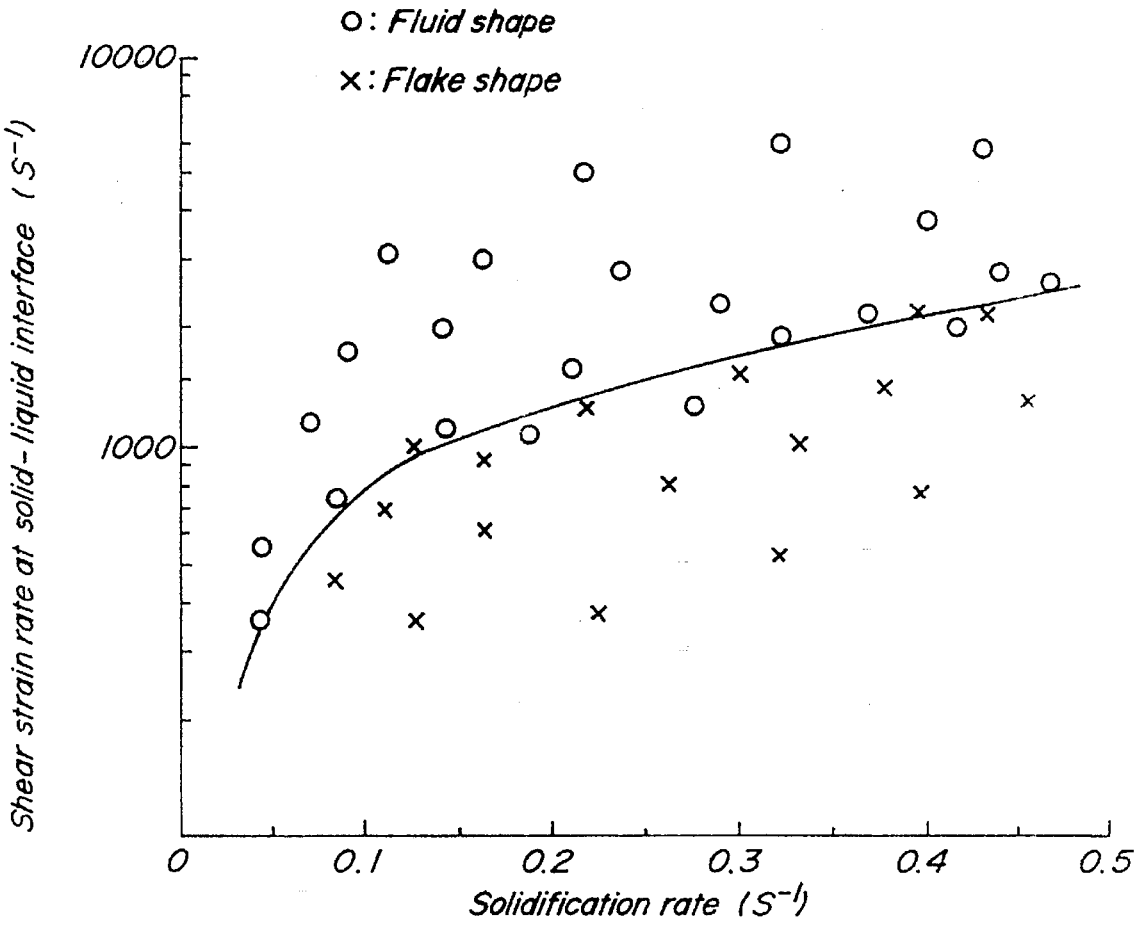
FIG. 6 is a graph showing a relation between solidification rate and shear strain rate to the properties of semi-solidified metal composition discharged.

The above experimental results are shown in FIG. 6 showing a relation between solidification rate and shear strain rate at the solid-liquid interface to the property of the semi-solidified metal composition discharged. The border line between flakes of the solid phase and the fluid of the liquid phase of the semi-solidified metal composition based on the results of FIG. 6 is expressed by the following equation (9), while the condition for obtaining the semi-solidified metal composition showing the fluid shape and good quality is expressed by the following equation (10).

$$\gamma = 8050\cdot(dfs/dt) \quad (9)$$

$$\gamma \geqq 8050\cdot(dfs/dt) \quad (10)$$

wherein $\gamma$: shear strain rate at solid-liquid interface (s$^{-1}$)

dfs/dt: solidification rate (s$^{-1}$)

As seen from the above, the semi-solidified metal composition having a fluid shape and a good quality can be obtained by properly selecting the shear strain rate at the solid-liquid interface based on the equation (10) in accordance with the solidification rate of molten metal.

Table 3 shows the shape of a semi-solidified metal composition, ratio of shear strain rate at the solid-liquid interface to solidification rate, occurring ratio of defects in cast product when the semi-solidified metal composition of Cu—8 mass % Sn alloy having a fraction solid of 0.3 produced in the apparatus of FIG. 5 is subjected to rheocasting in a die casting machine, while Table 4 shows the shape of semi-solidified metal composition, ratio of shear strain rate at the solid-liquid interface to solidification rate, occurring ratio of defects in cast product when the above semi-solidified metal composition is cooled and solidified and reheated to a semi-molten state having a fraction solid of 0.3–0.35 and then subjected to a thixocasting in a die casting machine.

TABLE 3

| Shape of semi-solidified metal composition | Shear strain rate/ solidification rate | Occurring ratio of defect |
|---|---|---|
| fluid | 9930 | small |
| flake | 5028 | large |

TABLE 4

| Shape of semi-solidified metal composition | Shear strain rate/ solidification rate | Occurring ratio of defect |
|---|---|---|
| fluid | 9930 | small |
| flake | 5028 | large |

As seen from Tables 3 and 4, when the ratio of shear strain rate at the solid-liquid interface to solidification rate is made large to render the shape of the semi-solidified metal composition into a fluid even in both the rheocasting and thixocasting, the occurring ratio of defects is small and sound cast products are obtained.

As mentioned above, the semi-solidified metal composition having an excellent castability and a good quality can be continuously discharged to largely reduce the occurring ratio of defects in the cast product by conducting the operation at the shear strain rate and solidification rate satisfying the relation of the above equation (8).

Figure 7:
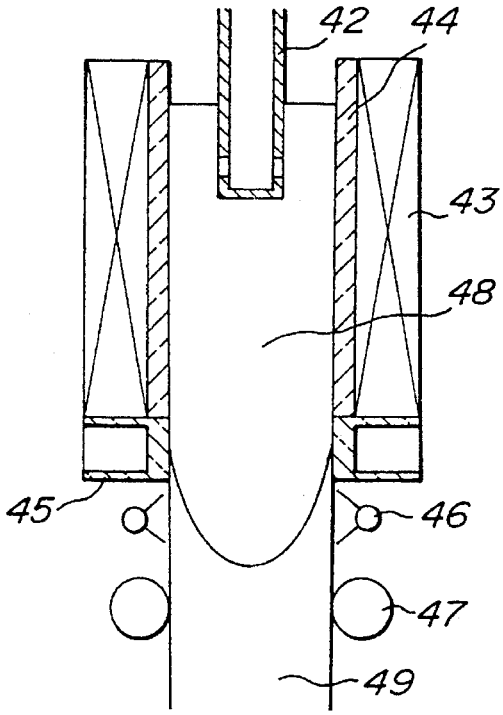
FIG. 7 is a diagrammatic view illustrating an apparatus for the production of semi-solidified metal composition through an electromagnetic agitating process provided with a continuously casting apparatus.
Figure 8:
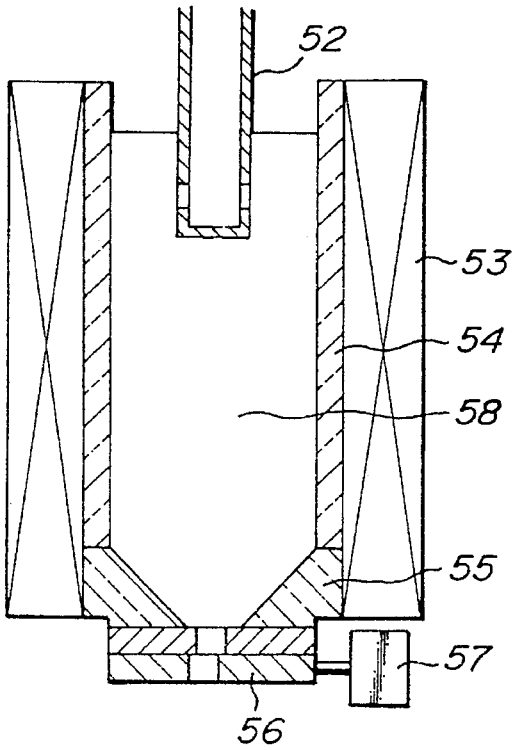
FIG. 8 is a diagrammatic view illustrating an apparatus for the production of semi-solidified metal composition through an electromagnetic agitating process provided with a sliding nozzle for controlling the discharge rate of semi-solidified metal composition.
Figure 9:
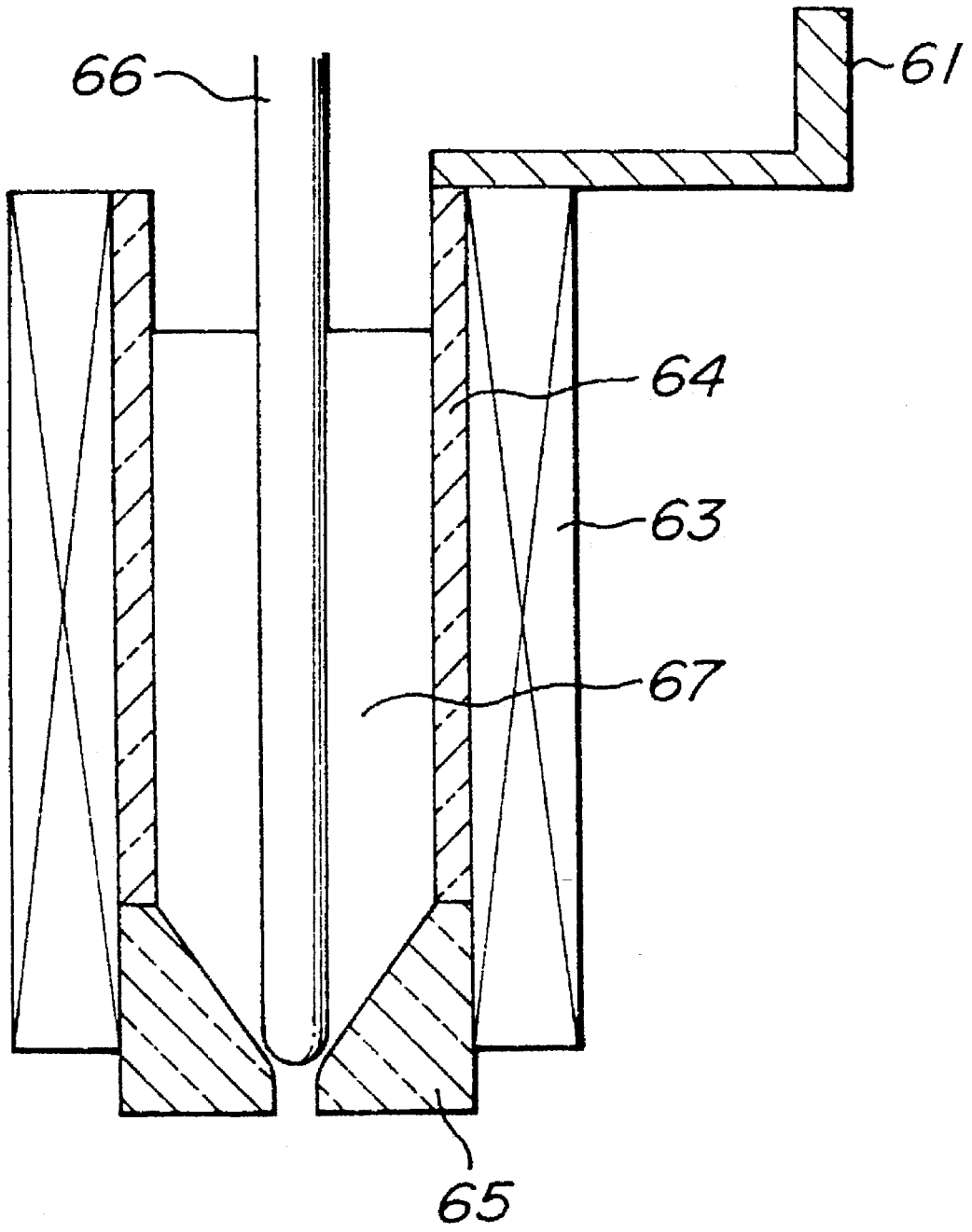
FIG. 9 is a diagrammatic view illustrating an apparatus for the production of semi-solidified metal composition through an electromagnetic agitating process provided with a stopper for controlling the discharge rate of semi-solidified metal composition.

Next, various semi-solidified metal compositions are produced through the apparatuses of FIGS. 7–9 and subjected to rheocasting or thixocasting in a die casting machine, during which stable operating conditions, particle size and dispersion state of non-dendritic primary solid particles in the resulting semi-solidified metal composition and the castability thereof are investigated.

In FIG. 7 is diagrammatically shown an apparatus for the production of the semi-solidified metal composition through an electromagnetic agitating process provided with a continuously casting machine, in which numeral 42 is an immersion nozzle, numeral 43 an electromagnetic induction coil, numeral 44 a cooling agitation mold for the control of cooling rate, numeral 45 a quenching and continuously casting mold, numeral 46 a sprayer for a cooling water, numeral 47 rolls for drawing out a cast slab, numeral 48 a semi-solidified metal composition, and numeral 49 a cast slab.

In FIG. 8 is diagrammatically shown an apparatus for the production of the semi-solidified metal composition through an electromagnetic agitating process provided with a sliding nozzle for the control of discharge rate, in which numeral 52 is an immersion nozzle, numeral 53 an electromagnetic induction coil, numeral 54 a cooling agitation mold for the control of cooling rate, numeral 55 a discharge nozzle provided with an adiabatic mechanism, numerals 56 a sliding nozzle for the control of discharge rate, numeral 57 a motor for the control of the sliding nozzle, and numeral 58 a semi-solidified metal composition.

In FIG. 9 is diagrammatically shown an apparatus for the production of the semi-solidified metal composition through an electromagnetic agitating process provided with a stopper for the control of the discharge rate, in which numeral 61 is a tundish, numeral 63 an electromagnetic induction coil, numeral 64 a cooling agitation mold for the control of cooling rate, numeral 65 a discharge nozzle provided with an adiabatic mechanism, numerals 66 a stopper for the control of discharge rate, and numeral 67 a semi-solidified metal composition.

In these experiments, the particle size and dispersion uniformity of the primary solid particles in the semi-solidified metal composition are controlled by the solidification rate of molten metal and shear strain rate at the solid-liquid interface (including shear strain rate at the solid-liquid interface in the inner wall face of the cooling agitation mold). The solidification rate is a rate of increasing fraction solid in the cooling agitation mold and is dependent upon unit amount of molten metal and cooling amount per unit of time. Therefore, the solidification rate is controlled by a cooling rate of the cooling agitation mold, and a cooling area of the cooling agitation mold and a space volume. Moreover, the cooling area and the space volume are defined at a position beneath an outer surface of the molten metal.

On the other hand, the fraction solid of the semi-solidified metal composition discharged is controlled by a discharge rate (or casting rate) and determined from a phase diagram based on temperatures measured by means of a thermocouple (not shown) arranged inside a lower portion of the cooling agitation mold.

The solidification rate is calculated according to the following equation (11) from the above determined fraction solid and a residence time in the cooling agitation mold:

$$\text{Solidification rate } (s^{-1}) = dfs/dt \tag{11}$$

wherein dfs: fraction solid of semi-solidified metal composition at an outlet port of the cooling agitation mold dt: space volume in cooling agitation mold ($m^3$)/discharge rate ($m^3/s$)

On the other hand, the shear strain rate at the solid-liquid interface (i.e. shear strain rate at the solid-liquid interface in the inner wall surface of the cooling agitation mold or in a surface of the solidification shell produced thereon) is possible to be calculated by conducting fluidization analysis in the inside of double cylinders for the electromagnetic agitation, but the calculated value becomes complicated, so that the shear strain rate is calculated according to the following more simple equation (12). $\Omega_M$ in the equation (12) is an average angular velocity of agitation stream of molten metal and is calculated according to the following equation (13).

The shear strain rate $\gamma$ in the inner surface of the cooling agitation mold or at the solid-liquid interface can be controlled by an angular velocity $\Omega_C$ of the rotating magnetic field in the electromagnetic induction coil, a magnetic flux density $B_0$ at a blank operation, a radius $r_2$ of the cooling agitation mold or a radius of the solid-liquid interface and the like in the equations (12) and (13).

Moreover, the value of $\alpha$ differs in accordance with the target alloy, fraction solid, frequency applied to the electromagnetic induction coil and the like, but is calculated according to the following equation (14) based on results of flow velocity previously measured by experiment of agitating molten metal.

$$\gamma = \frac{\sigma(\Omega_C - \Omega_M)\,\alpha^2 B_o^2}{4\mu}\,(r_2^2 - r_1^2) \tag{12}$$

$$\Omega_M = \frac{\dfrac{\sigma\Omega_C\alpha^2 B_o^2}{12\mu}\,(r_1 - r_2)^2}{1 + \dfrac{\sigma\alpha^2 B_o^2}{12\mu}\,(r_1 - r_2)^2} \tag{13}$$

$$Vr = \frac{\sigma(\Omega_C - \Omega_M)\,\alpha^2 B_o^2}{8\mu r}\,(r^2 - r_1^2)\,(r^2 - r_2^2) \tag{14}$$

($\gamma$: shear strain rate ($s^{-1}$)

wherein $\sigma$: electric conductivity of the molten metal ($\Omega^{-1}\cdot s^{-1}$)

$\Omega_C$: angular velocity of a rotating magnetic field in said cooling vessel (=2πf) (rad·s$^{-1}$)

f: frequency applied to said electromagnetic induction coil (Hz)

$\Omega_M$: average angular velocity of an agitation stream of molten metal (rad·s$^{-1}$)

$B_0$: magnetic flux density at blank operation (T)

α: magnetic efficiency in agitation of said molten metal $r_2$: radius of said cooling agitation mold or radius of said solid-liquid interface (m)

$r_1$: radius of said nozzle (m)

r: calculated radius of flow velocity of said molten metal (m)

Vr: peripheral flow velocity of said molten metal at a position of r (m/s)

The equations (12), (13) and (14) are flow equations and are induced as a steady laminar flow in the concentrically arranged double cylinders.

Figure 10:
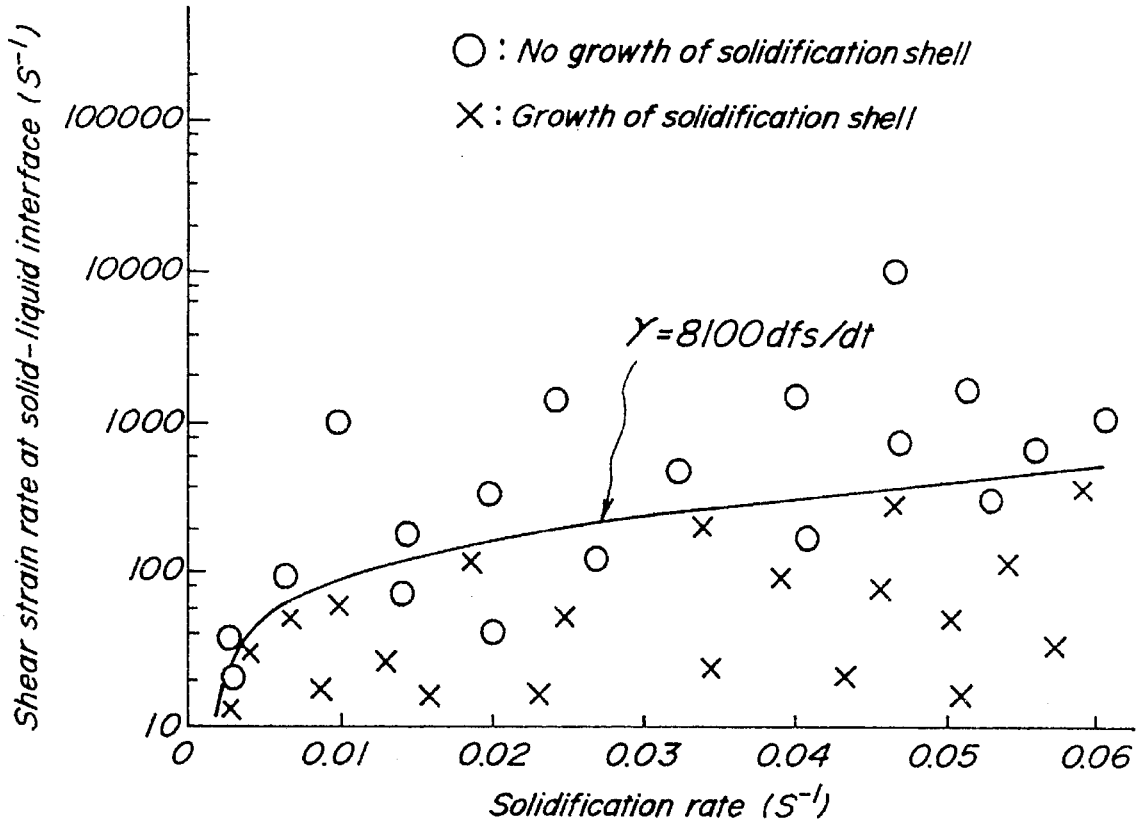
FIG. 10 is a graph showing a relation between solidification rate and shear strain rate at solid-liquid interface to the presence or absence of growth of solidification shell.

The growth of a solidification shell inside the cooling agitation mold is determined by measuring the thickness of the solidification shell after the removal of molten metal from the cooling agitation mold in the course of the operation in relation to the solidification rate and shear strain rate at the solid-liquid interface every given time, from which the presence or absence of solidification shell growth is plotted as a relation between solidification rate and shear strain rate in FIG. 10. As seen from FIG. 10, in order to prevent the solidification shell growth in the cooling agitation mold, it is necessary to increase the shear strain rate at the solid-liquid interface as the solidification rate becomes large, and the border line on the growth of solidification shell can be represented by the following equation (15):

$$\gamma=8100\times dfs/dt \quad (15)$$

wherein

γ: shear strain rate at solid-liquid interface (s$^{-1}$)

dfs/dt: solidification rate (s$^{-1}$)

When the shear strain rate inside the cooling agitation mold is larger than the value of the border line defined by the equation (15), the growth of the solidification shell is not naturally prevented in the cooling agitation mold. In the actual operation, however, it is preferable that the shear strain rate inside the cooling agitation mold is made larger than the value calculated from the equation (15) as far as possible in order to stably realize the continuous operation without the growth of a solidification shell because operational conditions such as cooling rate discharge rate and the like frequently change.

The semi-solidified metal composition produced through the electromagnetic agitating process will be described with respect to the particle size and dispersion state of non-dendritic primary solid particles and the workability below.

Figure 11:
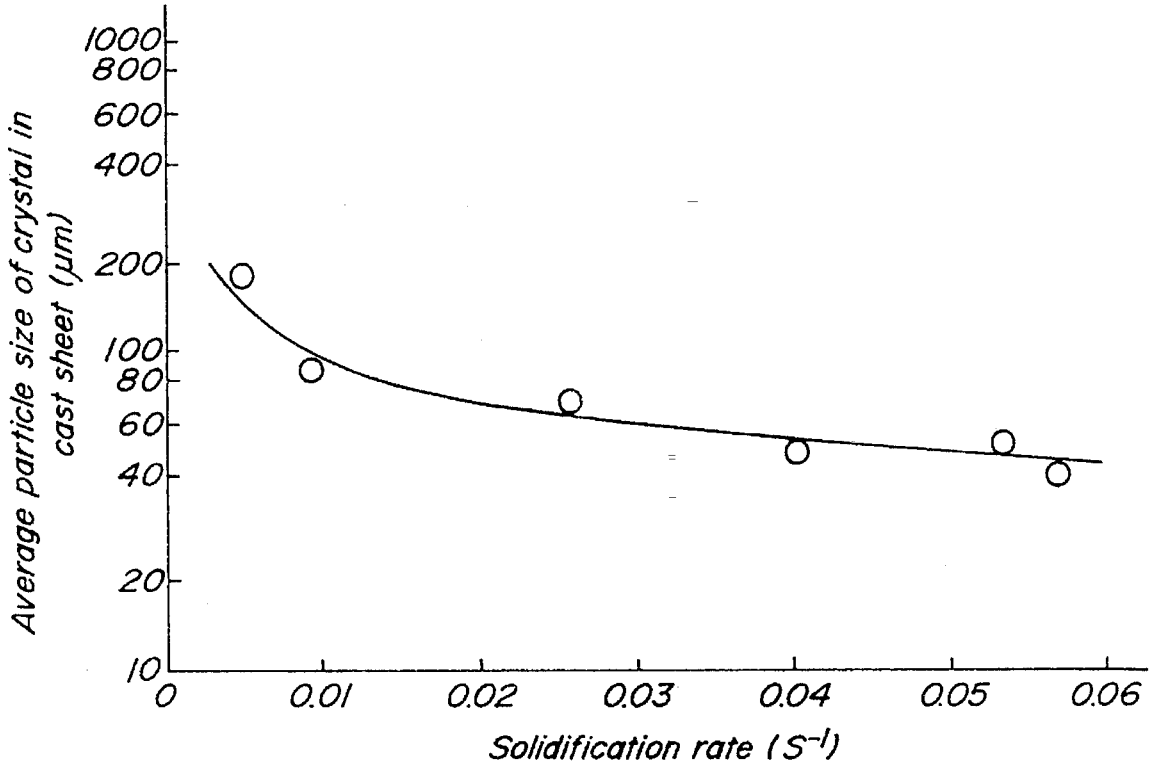
FIG. 11 is a graph showing an influence of solidification rate upon an average particle size of a cast sheet.

FIG. 11 is a graph showing an influence of solidification rate upon the average particle size in crystals of the case sheet obtained through the apparatus of FIG. 7, from which it is apparent that the average particle size of the crystals in the cast sheet (which is dependent upon the particle size of the primary solid particles) becomes small as the solidification rate is large.

Figure 12A:
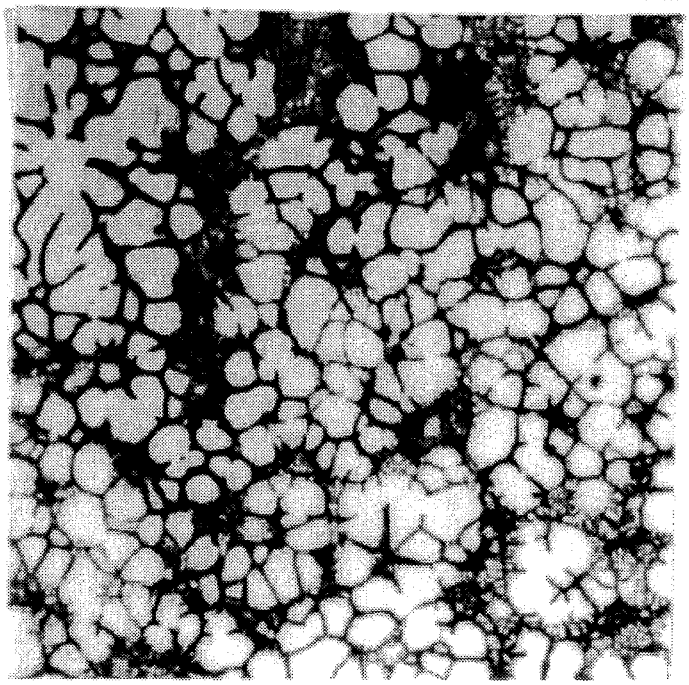
FIG. 12*a* is a microphotograph of a metal structure in a cast sheet when the shear strain rate at the solid-liquid interface is 200 $s^{-1}$.
Figure 12B:
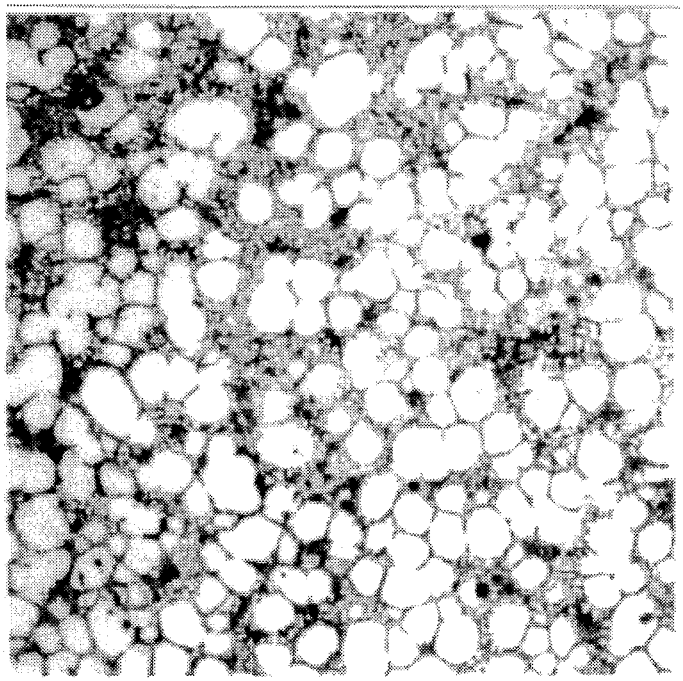
FIG. 12*b* is a microphotograph of a metal structure in a cast sheet when shear strain rate at solid-liquid interface is 1000 $s^{-1}$.

In FIGS. 12*a* and 12*b* are shown microphotographs of metal structures in cast sheets of Al alloy (made by the apparatus of FIG. 7) when the shear strain rate at the solid-liquid interface is 200 s$^{-1}$ and 1000 s$^{-1}$, respectively. From these microphotographs, it is apparent that the crystal grains are united in the case of FIG. 12*a* having a small shear strain rate at solid-liquid interface, while in the case of FIG. 12*b* having a large shear strain rate at the solid-liquid interface, the primary solid particles are uniformly dispersed owing to the strengthening of the agitation, which is guessed due to the fact that the agitation becomes vigorous and the cooling rate is more uniform as the shear strain rate at the solid-liquid interface becomes large.

As a result of observation on the metal structure of the sample obtained by rapidly solidifying the semi-solidified metal composition discharged from the apparatuses of FIGS. 8 and 9, it is also confirmed that the primary solid particles are made fine as the solidification rate becomes large, while the primary solid particles are more uniformly dispersed as the shear strain rate at the solid-liquid interface becomes large.

Table 5 shows continuously casting results of Al alloy through the apparatus of FIG. 7 as well as average particle size of a cast sheet, relation between solidification rate and shear strain rate at the solid-liquid interface, filling rejection ratio of cast product and the like when the Al alloy cast sheet is reheated to semi-molten state (fraction solid: 0.30–0.35) and then subjected to thixocasting in a die casting machine. Tables 6 and 7 show continuously discharging results of Al alloy and cast iron from the apparatus of FIG. 8 as well as particle size of primary solid particles, relation between solidification rate and shear strain rate at the solid-liquid interface, filling rejection ratio (n=50) of cast product and the like when the semi-solidified metal compositions of the discharged Al alloy and cast iron are subjected to rheocasting in a die casting machine (Table 6) or when the semi-solidified metal composition is poured into a mold, solidified, reheated to semi-molten state (fraction solid: 0.30–0.35) and then subjected to thixocasting in a die casting machine, respectively.

Tables 8 and 9 show continuously discharging results of Al alloy and cast iron from the apparatus of FIG. 9 as well as particle size of primary solid particles, relation between solidification rate and shear strain rate at the solid-liquid interface, filling rejection ratio (n=50) of worked product and the like when the semi-solidified metal compositions of the discharged Al alloy and cast iron are subjected to rheocasting in a die casting machine (Table 8) or to thixocasting in a die casting machine as mentioned above, respectively.

TABLE 5

| | Average particle size (μm) | Solidification rate at steady portion (A) (S$^{-1}$) | Shear strain rate inside mold* (B) (S$^{-1}$) | Presence or absence of solidification shell growth | (B)/(A) | Filling rejection ratio (%) | Continuous casting |
|---|---|---|---|---|---|---|---|
| Al alloy | 90 | 0.012 | 100 | big | 3000 | — | no casting |
| | 50 | 0.03 | 300 | small | 8030 | 2 | casting |
| | 40 | 0.062 | 500 | small | 8030 | 0 | casting |

TABLE 5-continued

| | Average particle size (μm) | Solidification rate at steady portion (A) ($S^{-1}$) | Shear strain rate inside mold* (B) ($S^{-1}$) | Presence or absence of solidification shell growth | (B)/(A) | Filling rejection ratio (%) | Continuous casting |
|---|---|---|---|---|---|---|---|
| | 50 | 0.03 | 500 | absence | 17000 | 0 | casting |
| | 100 | 0.01 | 100 | absence | 10000 | 10 | casting |
| | 100 | 0.01 | 400 | absence | 40000 | 4 | casting |

Note*:
In case of shell growth, ratio of shear strain rate (B') at solid-liquid interface at a position of growth stop to solidification rate (B'/A) is 8100.

TABLE 6

| | Average particle size (μm) | Solidification rate at steady portion (A) ($S^{-1}$) | Shear strain rate inside mold* (B) ($S^{-1}$) | Presence or absence of solidification shell growth | (B)/(A) | Filling rejection ratio (%) | Continuous discharge |
|---|---|---|---|---|---|---|---|
| Al alloy | 90 | 0.012 | 100 | big | 3000 | — | unacceptable due to torque rising |
| | 40 | 0.03 | 300 | small | 8030 | 2 | acceptable |
| | 40 | 0.06 | 500 | small | 8010 | 0 | acceptable |
| | 40 | 0.03 | 500 | absence | 17000 | 0 | acceptable |
| | 100 | 0.01 | 100 | absence | 10000 | 6 | acceptable |
| | 100 | 0.01 | 400 | absence | 40000 | 2 | acceptable |
| cast iron | 70 | 0.012 | 100 | big | 2500 | — | unacceptable due to torque rising |
| | 50 | 0.03 | 300 | small | 8020 | 2 | acceptable |
| | 50 | 0.03 | 500 | absence | 17000 | 0 | acceptable |
| | 70 | 0.01 | 100 | absence | 10000 | 8 | acceptable |
| | 70 | 0.01 | 400 | absence | 40000 | 4 | acceptable |

Note*:
In case of shell growth, ratio of shear strain rate (B') at solid-liquid interface at a position of growth stop to solidification rate (B'/A) is 8100.

TABLE 7

| | Average particle size (μm) | Solidification rate at steady portion (A) ($S^{-1}$) | Shear strain rate inside mold* (B) ($S^{-1}$) | Presence or absence of solidification shell growth | (B)/(A) | Filling rejection ratio (%) | Continuous discharge |
|---|---|---|---|---|---|---|---|
| Al alloy | 90 | 0.012 | 100 | big | 5000 | — | unacceptable due to torque rising |
| | 40 | 0.037 | 300 | small | 8030 | 2 | acceptable |
| | 40 | 0.05 | 500 | absence | 12500 | 0 | acceptable |
| | 100 | 0.009 | 100 | absence | 11000 | 10 | acceptable |
| | 100 | 0.009 | 400 | absence | 44000 | 4 | acceptable |
| cast iron | 70 | 0.012 | 100 | big | 4000 | - | unacceptable due to torque rising |
| | 50 | 0.05 | 300 | small | 8010 | 2 | acceptable |
| | 50 | 0.05 | 500 | absence | 10000 | 0 | acceptable |
| | 70 | 0.01 | 100 | absence | 10000 | 12 | acceptable |
| | 70 | 0.01 | 400 | absence | 40000 | 2 | acceptable |

Note*:
In case of shell growth, ratio of shear strain rate (B') at solid-liquid interface at a position of growth stop to solidification rate (B'/A) is 8100.

TABLE 8

| | Average particle size (μm) | Solidification rate at steady portion (A) ($S^{-1}$) | Shear strain rate inside mold* (B) ($S^{-1}$) | Presence or absence of solidification shell growth | (B)/(A) | Filling rejection ratio (%) | Continuous discharge |
|---|---|---|---|---|---|---|---|
| Al alloy | 90 | 0.012 | 100 | big | 2500 | — | unacceptable due to torque rising |
| | 40 | 0.03 | 300 | small | 8010 | 4 | acceptable |
| | 40 | 0.06 | 500 | small | 8020 | 0 | acceptable |
| | 40 | 0.03 | 800 | absence | 26600 | 0 | acceptable |
| | 100 | 0.01 | 100 | absence | 10000 | 6 | acceptable |
| | 100 | 0.01 | 400 | absence | 40000 | 2 | acceptable |
| cast iron | 70 | 0.012 | 100 | big | 3000 | — | unacceptable due to torque rising |
| | 50 | 0.031 | 500 | small | 8010 | 0 | acceptable |
| | 50 | 0.033 | 800 | absence | 24200 | 0 | acceptable |
| | 70 | 0.01 | 100 | absence | 10000 | 8 | acceptable |
| | 70 | 0.01 | 400 | absence | 40000 | 2 | acceptable |

Note*:
In case of shell growth, ratio of shear strain rate (B') at solid-liquid interface at a position of growth stop to solidification rate (B'/A) is 8100.

TABLE 9

| | Average particle size (μm) | Solidification rate at steady portion (A) ($S^{-1}$) | Shear strain rate inside mold* (B) ($S^{-1}$) | Presence or absence of solidification shell growth | (B)/(A) | Filling rejection ratio (%) | Continuous discharge |
|---|---|---|---|---|---|---|---|
| Al alloy | 90 | 0.012 | 100 | big | 3000 | — | unacceptable due to torque rising |
| | 40 | 0.04 | 300 | small | 8020 | 2 | acceptable |
| | 40 | 0.04 | 500 | absence | 12500 | 0 | acceptable |
| | 100 | 0.01 | 100 | absence | 10000 | 8 | acceptable |
| | 100 | 0.01 | 400 | absence | 40000 | 2 | acceptable |
| cast iron | 70 | 0.012 | 100 | big | 4000 | — | unacceptable due to torque rising |
| | 40 | 0.04 | 300 | small | 8010 | 2 | acceptable |
| | 40 | 0.04 | 500 | absence | 12500 | 0 | acceptable |
| | 70 | 0.01 | 100 | absence | 10000 | 6 | acceptable |
| | 70 | 0.01 | 400 | absence | 40000 | 2 | acceptable |

Note*:
In case of shell growth, ratio of shear strain rate (B') at solid-liquid interface at a position of growth stop to solidification rate (B'/A) is 8100.

In any case, when the shear strain rate inside the cooling agitation mold is lower than the value of the equation (15), or when the ratio of shear strain rate inside the cooling agitation mold to solidification rate is lower than 8100, the solidification shell is formed in the inner surface of the cooling agitation mold and grown to decrease the cooling rate (solidification rate). When the ratio of shear strain rate inside the cooling agitation mold to solidification rate reaches the above value, the growth of solidification shell is obstructed. Even in this case, therefore, the solidification rate can be increased by making large the shear strain rate under the growth of the solidification shell and the particle size of the primary solid particles can be made fine. However, when the solidification shell too grows in the cooling agitation mold, it is impossible to conduct the continuous casting or continuous discharge.

On the other hand, when the ratio of shear strain rate inside the cooling agitation mold to solidification rate is more than 8100 under conditions not growing a solidification shell, it is possible to conduct the continuous casting or continuous discharge without troubles, and the crystal grain size or particle size of primary solid particles depending upon the solidification rate is small, and the filling rejection ratio in the die casting machine becomes small as the shear strain rate at the solid-liquid interface becomes large and hence the castability is improved.

As mentioned above, in the electromagnetic agitating process according to the invention, the growth of a solidification shell in the cooling agitation mold can be prevented to stably conduct the continuous operation by rationalizing the ratio of shear strain rate at the solid-liquid interface to solidification rate. As a result, the solidification rate of molten metal can be increased and the formation of fine particle size is facilitated. Moreover, the fine particle size and uniform dispersion of the primary solid particles can be attained by making large the shear strain rate at the solid-liquid interface with the increase of the solidification rate, whereby semi-solidified metal compositions having an excellent castability for thixocasting, rheocasting or casting can be produced stably and continuously.

The following examples are given in illustration of the invention and are not intended as limitations thereof.

EXAMPLE 1

A semi-solidified metal composition of AC4C (Al alloy) is continuously produced by using the apparatus shown in FIG. 1 under various conditions and then subjected to rheocasting or thixocasting.

A molten metal 1 of AC4C (Al alloy) is charged at a proper temperature into a temperature controlled vessel 5 through a tundish 2 and agitated in a cooling vessel 6 by the rotation of an agitator 10 provided at its outer surface with screw threads while cooling to form a metal slurry of solid-liquid mixture containing fine non-dendritic primary solid particles therein, which is discharged from a sliding nozzle 12 through a temperature holding vessel 7 as a semi-solidified metal composition.

In this case, the temperature controlled vessel 5, temperature holding vessel 7 and sliding nozzle 12 are preliminarily heated to target temperatures by an embedded heater 11 and a burner (not shown), while the solidification rate of the molten metal 1 is adjusted by a cooling rate, cooling area and volume of the cooling vessel 6 and the shear strain rate at the solid-liquid interface is controlled by a revolution number of the agitator 10. An initially set clearance between the agitator 10 and a cooling wall member 8 of the cooling vessel 6 is 15 mm. The residence time of the molten metal in the cooling vessel 6 is adjusted so as to have a fraction solid of semi-solidified metal composition of 0.3 by controlling the opening and closing of the sliding nozzle 12.

As a result of examination on behavior of torque increase of the agitator 10 and behavior on growth of solidification shell, it is confirmed that the torque increase starts when the clearance S between the agitator 10 and the grown solidification shell becomes small and reaches about 0.8 mm. Therefore, the clearance S of 0.8 mm is adopted in the calculation of the shear strain rate at the solid-liquid interface from the equations (2) and (3) as previously mentioned. That is, as the value of the clearance S becomes smaller than 0.8 mm, the growth of solidification shell on the inner surface of the cooling wall member 8 becomes conspicuous and finally stops the torque increase of the agitator 10.

As previously shown in FIG. 2, the presence or absence of torque increase of the agitator 10 in the production of semi-solidified metal compositions under the above various conditions is represented by the relation between shear strain rate at the solid-liquid interface and solidification rate of molten metal calculated by the above equations, from which it is obvious that the border line for the torque increase is represented by the equation (4) and the condition of causing no torque increase can be represented by the equation (5). That is, the torque increase of the agitator 10 can be prevented to continuously discharge the resulting semi-solidified metal composition by rationalizing the ratio of shear strain rate at the solid-liquid interface to solidification rate or restricting such a ratio to a value exceeding 8000.

On the other hand, the particle size and dispersion state of non-dendritic primary solid particles in the semi-solidified metal composition discharged are investigated by observing samples of the semi-solidified metal composition rapidly solidified between copper plates by means of a microscope, from which a relation between particle size of primary solid particles and solidification rate as previously shown in FIG. 3 is obtained. As seen from FIG. 3, the particle size of primary solid particles in the semi-solidified metal composition discharged becomes small as the solidification rate increases. Moreover, the metal structure showing the dispersion state of the primary solid particles is shown in FIGS. 4*a* and 4*b* having a different shear strain rate at the solid-liquid interface, respectively, in which FIG. 4*a* is a case that shear strain rate is 500 $s^{-1}$, solidification rate is 0.03 $s^{-1}$ and ratio of shear strain rate to solidification rate is 15150, and FIG. 4*b* is a case that shear strain rate is 15000 $s^{-1}$, solidification rate is 0.03 $s^{-1}$ and ratio of shear strain rate to solidification rate is 454550. As seen from the comparison of FIGS. 4*a* and 4*b*, the primary solid particles can uniformly be dispersed without the formation of aggregate by increasing the shear strain rate at the solid-liquid interface.

The semi-solidified metal composition discharged (fraction solid: 0.3) is poured into a preliminarily heated Kaowool vessel and transferred to a die casting machine, at which rheocasting is carried out. On the other hand, the same semi-solidified metal composition as mentioned above is cooled and solidified in a mold and reheated to a semi-molten state having a fraction solid of 0.3–0.35, which is subjected to thixocasting in a die casting machine. Then, the filling rejection ratio of cast products (n=50) is investigated. Moreover, the examination of the filling rejection is carried out by visual observation and measurement of density. The measured results are shown in Tables 1 and 2, from which it is understood that when the ratio of shear strain rate at the solid-liquid interface to solidification rate is not more than 8000, the continuous discharge cannot be conducted and that the filling rejection ratio is somewhat improved by making large the solidification rate to make the particle size of the primary solid particles fine but the filling rejection ratio is further improved by making large the shear strain rate at the solid-liquid interface in addition to the fine formation of primary solid particles. In other words, when the ratio of shear strain rate at the solid-liquid interface to solidification rate exceeds 8000, the growth of a solidification shell in the cooling agitation mold is prevented to facilitate the continuous operation and the castability of the semi-solidified metal composition discharged can largely be improved.

EXAMPLE 2

500 kg of a semi-solidified metal composition of Cu—8 mass % Sn alloy (liquids temperature: 1030° C., solids temperature: 851° C.) is continuously produced through the apparatus of FIG. 5, while the semi-solidified metal composition discharged was subjected to rheocasting or thixocasting.

In the production of the semi-solidified metal composition, the molten alloy 36 was poured at a temperature of 1070° C. from the ladle 34 through the nozzle 35 into a space between the rotating agitator 21 and the refractory plate 24 or into the cooling agitation mold 39 and then continuously discharged from the discharge port 32 as a semi-solidified metal composition having a fraction solid of 0.3 by rendering a clearance between the agitator 21 and the dam plate 28 into 1 mm and varying the revolution number of the agitator 21 within a range of 40–430 rpm to control the shear strain rate and discharge rate.

The rotating agitator 21 was composed of a Cu cylindrical drum having a radius of 200 mm and a width of 100 mm, while the control of solidification rate was carried out by changing the thickness of the drum into 30, 25, 20, 15 and 10 mm. Moreover, the refractory plate 24 was preliminarily heated to 1100° C. by means of the heater 26.

As previously mentioned on FIG. 6, the flake shape of the semi-solidified metal composition 38 can be prevented by rationalizing the shear strain rate at the solid-liquid interface in accordance with the solidification rate for controlling the properties of the metal composition such as particle size of primary solid particles and the like.

Figure 13:
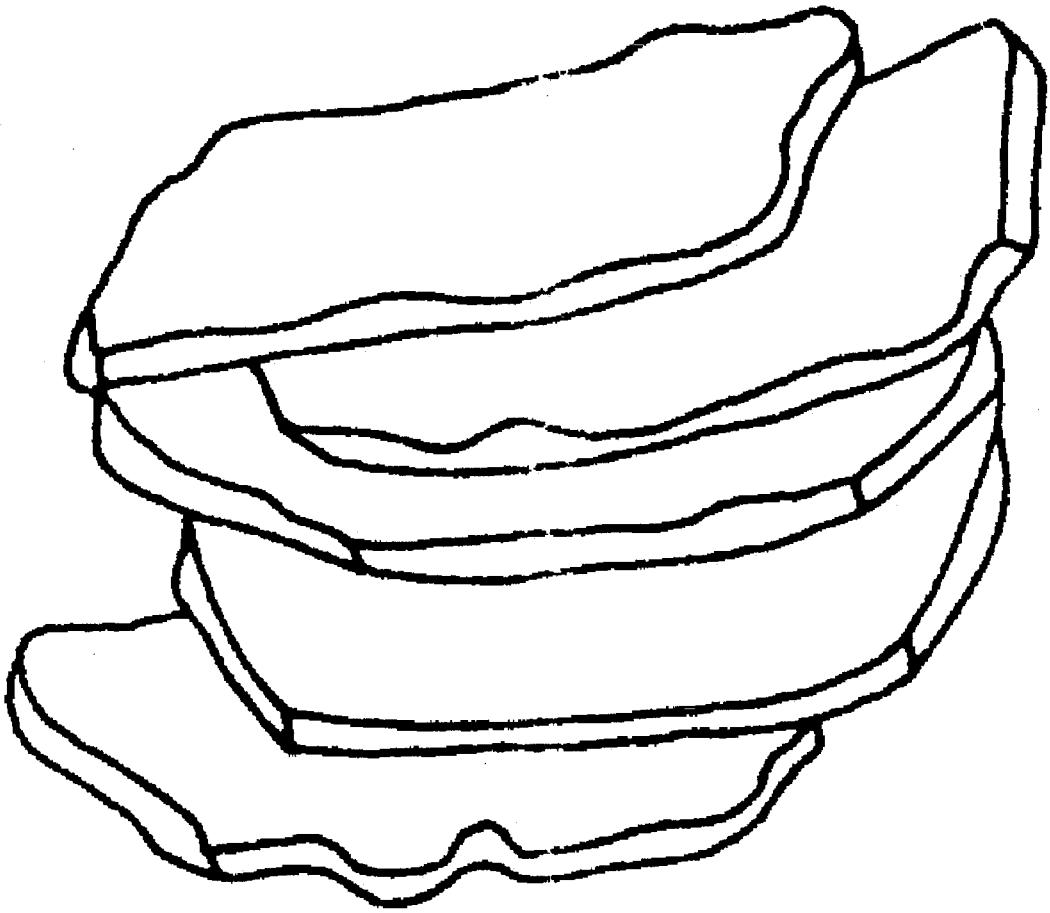
FIG. 13 is a perspective view showing a flaky shape of a semi-solidified metal composition.
Figure 14:
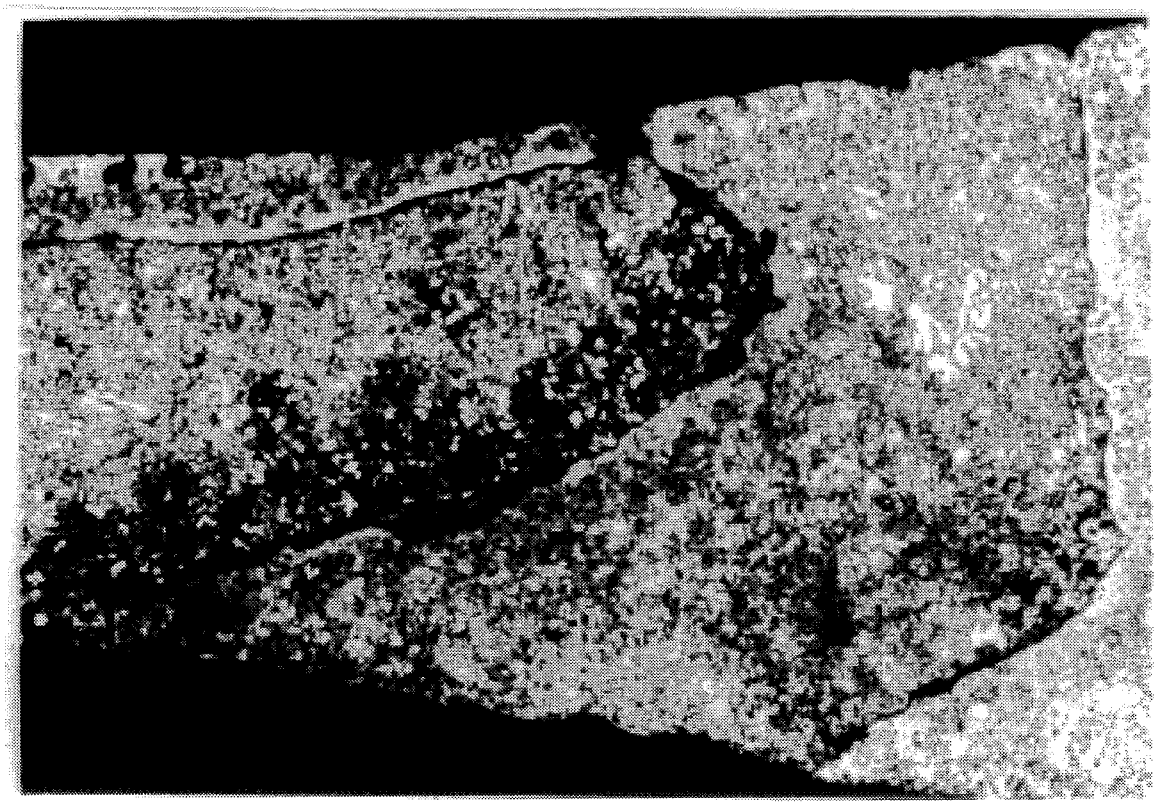
FIG. 14 is a microphotograph of a metal structure in section of the flaky semi-solidified metal composition.

In FIG. 13 is schematically shown an appearance of flaky semi-solidified metal composition and FIG. 14 shows a microphotograph of a metal structure in section of the flaky semi-solidified metal composition, from which the metal structure is understood to be lamellar. Therefore, good castability cannot be expected by subjecting the flaky semi-solidified metal composition to various workings.

On the other hand, when the semi-solidified metal composition of fluid shape according to the invention is subjected to rheocasting or thixocasting, the occurring ratio of defects in the cast product is largely improved as seen from Tables 3 and 4, in which the occurring ratio of defects is measured by an area ratio of voids per 1 $mm^2$ of sectional area of the cast product.

EXAMPLE 3

A semi-solidified metal composition was produced by using the electromagnetic agitating process provided with a continuously casting machine as shown in FIG. 7, in which molten metal of AC4C (Al alloy) was charged into the cooling agitation mold 44 through the immersion nozzle 42, electromagnetically agitated in the mold through the electromagnetic induction coil 43 while cooling under various conditions, cast in the quenching and continuously casting mold 45, cooled by the cooling water sprayer 46 and drawn out through the rolls 47 as a cast slab 49.

In this case, the solidification rate was controlled by the cooling rate, cooling area and volume of the cooling agitation mold 44 and calculated by the equation (11) from fraction solid, which was determined from temperature measured by the thermocouple disposed inside the cooling agitation mold 44 and phase diagram of alloy, and the residence time inside the cooling agitation mold 44. Moreover, the fraction solid was adjusted by a casting rate.

The shear strain rate at the solid-liquid interface was calculated by the equation (12) while controlling the average angular velocity $\Omega_M$ of agitated molten metal in the cooling agitation mold 44 by current, frequency and the like applied to the electromagentic induction coil 43 according to the equation (13).

In the equations (12) and (13), the magnetic flux density $B_0$ in the electromagnetic induction coil 43 at the blank operation was used by formulating the measured value in the coil as a function of current and frequency applied to the coil in the measurement. Further, the magnetic efficiency $\alpha$ is determined by the equation (14) using a peripheral velocity of molten metal located at a half radius portion of the cooling agitation mold 44 previously measured in the agitation test of molten metal.

As previously mentioned on FIG. 10, the border condition for the presence or absence of solidification shell growth in the cooling agitation mold 44 can be represented by the equation (15) as a function of shear strain rate at the solid-liquid interface and solidification rate. In order to prevent the growth of a solidification shell in the inner surface of the cooling agitation mold 44 and obtain semi-solidified metal composition having good castability, it is important that the shear strain rate inside the cooling agitation mold 44 exceeds a value satisfying the equation (15) together with a high solidification rate required for the fine formation of solidification structure. When the shear strain rate inside the cooling agitation mold 44 is larger than the border condition of the equation (15), even if the operational conditions such as cooling rate, casting rate and the like change, the stable operation can be conducted without the growth of a solidification shell, so that it is favorable to make the value of the shear strain rate inside the cooling agitation mold 44 as large as possible.

Moreover, when the ratio of shear strain rate at the solid-liquid interface inside the cooling agitation mold 44 to solidification rate is somewhat smaller than 8100, the solidification shell slightly grows on the inner surface of the mold until the ratio reaches 8100, but it is possible to conduct the continuous operation because the solidification shell grown is drawn out downward. Even in this case, when the shear strain rate at the solid-liquid interface is increased with the increase of the solidification rate, the continuous operation is possible and the castability of the cast product is improved.

In this connection, the particle size of primary solid particles in the semi-solidified metal composition is made fine as the solidification rate becomes large as previously mentioned on FIG. 11. As seen from the comparison of FIGS. 12*a* and 12*b*, when the shear strain rate at the solid-liquid interface is made large at the same solidification rate of 0.02, the particle size and dispersion state of the primary solid particles are more uniformized.

As seen from the results of Table 5 measured when the the resulting cast sheet is subjected to thixocasting in a die casting machine, it is difficult to conduct the continuous operation if the ratio of shear strain rate inside the cooling agitation mold 44 to solidification rate is not more than 8000, while if such a ratio is more than 8000 but not more than 8100, the solidification shell grows until the ratio reaches 8100 but the continuous operation is possible. In this case, the shear strain rate at the solid-liquid interface is increased to increase the solidification rate, whereby the castability is improved. Furthermore, when the ratio capable of conducting the continuous operation exceeds 8000, the filling rejection ratio can be improved by increasing the solidification rate to make the average particle size fine and increasing the shear strain rate at the solid-liquid interface to uniformize the average particle size.

EXAMPLE 4

Semi-solidified metal compositions of AC4C (Al alloy) and cast iron are continuously discharged under various conditions by adjusting an opening degree of the sliding nozzle 56 so as to have a fraction solid discharge of 0.3 by means of the apparatus for the production of the semi-solidified metal composition through an electromagnetic agitating process provided with a sliding nozzle for the control of discharge rate as shown in FIG. 8.

As a result, when the shear strain rate inside the cooling agitation mold 54 is made larger than the value of the equation (15) in relation to the solidification rate, the growth of solidification shell in the cooling agitation mold 54 can be prevented likewise as in Example 3.

As seen from the results of Tables 6 and 7 measured when the resulting semi-solidified metal composition is subjected to rheocasting or thixocasting in a die casting machine, if the ratio of shear strain rate inside the cooling agitation mold 54 to solidification rate is more than 8000 and reaches 8100, the solidification shell grows, but the thickness of the solidification shell is thin and it is possible to conduct the continuous discharge. In this case, the shear strain rate at the solid-liquid interface is increased to increase the solidification rate, whereby the castability is improved. On the other hand, when the ratio of shear strain rate inside the cooling agitation mold 54 to solidification rate is not more than 8000, the solidification shell grown inside the cooling agitation mold 54 is very thick and it is difficult to conduct the continuous discharge. Furthermore, when the ratio capable of conducting the continuous discharge exceeds 8000, the filling rejection ratio and the castability in the rheocasting and thixocasting can be improved by increasing the solidification rate and the shear strain rate at the solid-liquid interface.

EXAMPLE 5

Semi-solidified metal compositions of AC4C (Al alloy) and cast iron were continuously discharged under various conditions by adjusting an opening degree of the stopper 66 so as to have a fraction solid discharged of 0.3 by means of the apparatus for the production of the semi-solidified metal composition through an electromagnetic agitating process provided with a stopper for the control of discharge rate as shown in FIG. 9.

As a result, when the shear strain rate inside the cooling agitation mold 64 is made larger than the value of the equation (15) in relation to the solidification rate, the growth of a solidification shell in the cooling agitation mold 64 can be prevented likewise as in Example 3.

As seen from the results of Tables 8 and 9 measured when the the resulting semi-solidified metal composition is subjected to rheocasting or thixocasting in a die casting machine, if the ratio of shear strain rate inside the cooling agitation mold 64 to solidification rate is more than 8000 and reaches 8100, the solidification shell grows, but the thickness of the solidification shell is thin and it is possible to conduct the continuous discharge. In this case, the shear strain rate at the solid-liquid interface is increased to increase the solidification rate, whereby the castability is improved. On the other hand, when the ratio of shear strain rate inside the cooling agitation mold 64 to solidification rate is not more than 8000, the solidification shell grown inside the cooling agitation mold 54 is very thick and it is difficult to conduct the continuous discharge. Furthermore, when the ratio capable of conducting the continuous discharge exceeds 8000, the filling rejection ratio and the castability in the rheocasting and thixocasting can be improved by increasing the solidification rate and the shear strain rate at the solid-liquid interface.

As mentioned above, according to the invention, the semi-solidified metal compositions having an excellent workability cam continuously be produced by rendering the ratio of shear strain rate at the solid-liquid interface to solidification rate into a value exceeding 8000 irrespectively of the kind of the cooling agitation process. Furthermore, the thus obtained semi-solidified metal compositions advantageously realize near-net-shape process as a material for rheocasting, thixocasting and casting and largely reduce working energy and improve the casting yield.

What is claimed is:

1. A process for continuously producing semi-solidified metal compositions having excellent castability comprising 1) pouring molten metal into an upper part of a cooling agitation mold, said cooling agitation mold comprising a cooling vessel, an agitator arranged in the vessel apart from an inner cooling face thereof and a nozzle for controlling an amount of slurry discharged from said cooling agitation mold, said slurry being a solid-liquid mixed phase containing non-dendritic primary solid particles dispersed therein, 2) agitating the molten metal and 3) adjusting a ratio of shear strain rate at a solid-liquid interface of said slurry to a solidification rate of said molten metal to a value exceeding 8000 in the cooling agitation mold while cooling to produce said slurry and 4) discharging the slurry from a lower part of the cooling agitation mold, said ratio being adjusted by adjusting said solidification rate according to formula (1):

$$\text{solidification rate } (s^{-1}) = dfs/dt \quad (1)$$

wherein wherein dfs: solid fraction of semi-solidified metal composition discharged from said cooling agitation mold dt: space volume of said cooling vessel ($m^3$)/discharge rate of said slurry ($m^3/s$), and by adjusting said shear strain rate according to formulae (2) and (3):

$$\gamma = 2 \cdot r_1 \cdot r_3 \cdot \Omega / (r_3^2 - r_1^2) \quad (2)$$

$$r_3 = r_2 - D = S + r_1 \quad (3)$$

wherein $\gamma$: shear strain rate at said solid-liquid interface ($s^{-1}$)

$r_1$: radius of said agitator (m)

$r_2$: inner radius of said cooling vessel (m)

$\Omega$: angular velocity of said agitator (rad/s)

S: clearance (m) between said cooling vessel and said agitator $r_3$: radius of molten metal in said cooling vessel (m)

D: thickness of a solidification shell (m) formed on said agitator.

2. The process defined in claim 1 further comprising adjusting the torque of the agitator according to formula (5):

$$\gamma \geqq 8033 \cdot (dfs/dt) \quad (5)$$

wherein $\gamma$=shear strain rate at the solid-liquid interface, and (dfs/dt)=the solidification rate ($s^{-1}$).

3. A process for continuously producing semi-solidified metal compositions having excellent castability comprising 1) pouring molten metal into an upper part of a cooling agitation mold, said cooling agitation mold comprising a rotating cylindrical drum agitator having a horizontally rotational axis and a cooling wall member having a concave face along an outer periphery of the drum, a scraping member for scraping a solidification shell adhered to the outer periphery of the drum, and a nozzle for controlling the amount of a slurry discharged from said cooling agitation mold, said slurry being a solid-liquid mixed phase containing non-dendritic primary solid particles dispersed therein, 2) agitating the molten metal, 3) adjusting a ratio of shear strain rate at a solid-liquid interface of said slurry to a solidification rate of said molten metal adjusted to a value exceeding 8000 in the cooling agitation mold while cooling to produce said slurry and 4) discharging the slurry from a lower part of the cooling agitation mold, said ratio being adjusted by adjusting said solidification rate according to formula (1):

$$\text{solidification rate } (s^{-1}) = dfs/dt \quad (1)$$

wherein dfs: solid fraction of semi-solidified metal composition discharged from said cooling agitation mold dt: space volume of said cooling agitation mold ($m^3$)/discharge rate of said slurry ($m^3/s$), and by adjusting said shear strain rate according to formulae (7) and (8):

$$\gamma=2\times(2\cdot\pi\cdot n)\times\{r_2\times(r_2+h)\}/(h^2+2\cdot r_2\cdot h) \quad (7)$$

$$r_2=r_1+t \quad (8)$$

wherein $\gamma$: shear strain rate at said solid-liquid interface ($s^{-1}$)

n: revolution number of said cylindrical drum agitator ($s^{-1}$)

$r_1$: radius of said cylindrical drum agitator (m)

t: thickness of said solidification shell (m)

h: clearance between said solidification shell and said nozzle (m).

4. The process defined in claim 3 further comprising adjusting the torque of the cylindrical drum agitator according to formula (10):

$$\gamma\geqq 8050\cdot(dfs/dt) \quad (10)$$

wherein $\gamma$=shear strain rate at the solid-liquid interface and (dfs/dt)=the solidification rate ($s^{-1}$).

5. A process for continuously producing semi-solidified metal compositions having excellent castability comprising 1) pouring molten metal into an upper part of a cooling agitation mold, said agitation cooling mold comprising a cooling vessel, an electromagnetic induction coil arranged around an outer periphery of the vessel and a discharge nozzle for controlling the amount of slurry discharged from said cooling agitation mold, said slurry being a solid-liquid mixed phase containing non-dendritic primary solid particles dispersed therein, 2) agitating the molten metal and 3) adjusting a ratio of shear strain rate at a solid-liquid interface of said slurry to a solidification rate of said molten metal adjusting to a value exceeding 8000 in the cooling agitation mold while cooling to produce said slurry and 4) discharging the slurry from a lower part of the cooling agitation mold, said ratio being adjusted by adjusting said solidification rate according to formula 11:

$$\text{solidification rate } (s^{-1})-dfs/dt \quad (11)$$

wherein dfs: solid fraction of semi-solidified metal composition discharged from said cooling agitation mold and dt: space volume in said cooling agitation mold ($m^3$)/ discharge rate of said slurry ($m^3/s$)

and by adjusting said shear strain rate according to formulae (12), (13) and (14):

$$\gamma=\frac{\sigma(\Omega_c-\Omega_M)\,\alpha^2B_0^2}{4\mu}\,(r_2^2-r_1^2) \quad (12)$$

$$\Omega_M=\frac{\dfrac{\sigma\Omega_c\alpha^2B_0^2}{12\mu}\,(r_1-r_2)^2}{1+\dfrac{\sigma\alpha^2B_0^2}{12\mu}\,(r_1-r_2)^2} \quad (13)$$

$$Vr=\frac{\sigma(\Omega_c-\Omega_M)\,\alpha^2B_0^2}{8\mu r}\,(r^2-r_1^2)(r^2-r_2^2) \quad (14)$$

wherein $\gamma$: shear strain rate ($s^{-1}$)

$\sigma$: electric conductivity of the molten metal ($\Omega^{-1}\cdot s^{-1}$)

$\Omega_C$: angular velocity of a rotating magnetic field in said cooling vessel formed by said electromagnetic induction coil ($=2\pi f$) ($rad\cdot s^{-1}$)

f: frequency applied to said electromagnetic induction coil (Hz)

$\Omega_M$: average angular velocity of an agitation stream of said molten metal ($rad\cdot s^{-1}$)

$B_0$: magnetic flux density at blank operation (T)

$\alpha$: magnetic efficiency in agitation of said molten metal $r_2$: radius of said cooling agitation mold or radius of said solid-liquid interface (m)

$r_1$: radius of said nozzle r: calculated radius of flow velocity of said molten metal (m)

Vr: peripheral flow velocity of said molten metal at a position of r (m/s).

6. The process defined in claim 5 further comprising controlling the solidification shell growth on an inner surface of said cooling vessel according to formula (15):

$$\gamma\geqq 8100\cdot(dfs/dt) \quad (15)$$

wherein $\gamma$=shear strain rate at the solid-liquid interface and (dfs/dt)=the solidification rate ($s^{-1}$).

* * * * *

UNITED STATES PATENT AND TRADEMARK OFFICE

CERTIFICATE OF CORRECTION

PATENT NO. : 5,555,926

DATED : September 17, 1996

INVENTOR(S) : Mitsuo Uchimura et al

It is certified that error appears in the above-indentified patent and that said Letters Patent is hereby corrected as shown below:

On the title page, at [75], second line, please change "Hiroyshi" to --Hiroyoshi--.

--composition-- and after "castability", please insert --, wherein a stopper means is provided in said mold for controlling rate of flow of said molten metal,--;

line 24, after "pouring", please insert --said--;

line 27, please change "vessel and a" to --vessel, a--; and line 28, after "nozzle", please insert --and a stopper means--.

In Column 23, line 22, please change "A process for" to --A continuous process for casting a molten metal in a mold and-- and before "semi-solidified", please insert --a--;

line 23, please change "compositions" to

UNITED STATES PATENT AND TRADEMARK OFFICE

CERTIFICATE OF CORRECTION

PATENT NO. : 5,555,926

DATED : September 17, 1996

INVENTOR(S) : Mitsuo Uchimura et al

It is certified that error appears in the above-indentified patent and that said Letters Patent is hereby corrected as shown below:

In Column 24, line 30, please change "nozzle" to --stopper means--.

Signed and Sealed this

Eighteenth Day of February, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,555,926

DATED : September 17, 1996

INVENTOR(S) : Mitsuo Uchimura et al

It is certified that error appears in the above-indentified patent and that said Letters Patent is hereby corrected as shown below:

On the title page, at [75], second line, please change "Hiroyshi" to --Hiroyoshi--.

In column 1, line 9, please delete "an"; and line 58, please change "in the working" to -- during casting --.

In column 4, line 2, after "when", please insert --the-- and after "at", please insert --the --.

In column 8, line 60, before "semi-solidified", please insert --a--.

In Column 23, line 22, please change "A process for" to --A continuous process for casting a molten metal in a mold and-- and before "semi-solidified", please insert --a--;

line 23, please change "compositions" to --composition-- and after "castability", please insert --, wherein a stopper means is provided in said mold for controlling rate of flow of said molten metal,--;

line 24, after "pouring", please insert --said--;

UNITED STATES PATENT AND TRADEMARK OFFICE

CERTIFICATE OF CORRECTION

PATENT NO. : 5,555,926

DATED : September 17, 1996

INVENTOR(S) : Mitsuo Uchimura et al

It is certified that error appears in the above-indentified patent and that said Letters Patent is hereby corrected as shown below:

line 27, please change "vessel and a" to --vessel, a--; and line 28, after "nozzle", please insert --and a stopper means--.

In Column 24, line 30, please change "nozzle" to --stopper means--.

This certificate supersedes Certificate of Correction issued February 18, 1997.

Signed and Sealed this

Thirteenth Day of May, 1997

Bruce Lehman

*Attest:*

BRUCE LEHMAN

*Attesting Officer*

*Commissioner of Patents and Trademarks*